US012778279B2

(12) United States Patent
Samikkannu et al.

(10) Patent No.: US 12,778,279 B2
(45) Date of Patent: Nov. 3, 2026

(54) FOLDABLE TABLE WITH LOCKING MECHANISM

(71) Applicant: AmTab Manufacturing Corporation, Bensenville, IL (US)

(72) Inventors: Doss Samikkannu, Des Plaines, IL (US); Jeremias Rivera, Elmhurst, IL (US)

(73) Assignee: AmTab Manufacturing Corporation, Bensenville, IL (US)

( * ) Notice: Subject to any disclaimer, the term of this patent is extended or adjusted under 35 U.S.C. 154(b) by 98 days.

(21) Appl. No.: 18/911,544

(22) Filed: Oct. 10, 2024

(65) Prior Publication Data

US 2025/0359663 A1 Nov. 27, 2025

Related U.S. Application Data

(60) Provisional application No. 63/651,603, filed on May 24, 2024.

(51) Int. Cl.
*A47B 3/14* (2006.01)

(52) U.S. Cl.
CPC ..... *A47B 3/14* (2013.01); *A47B 2003/145* (2013.01)

(58) Field of Classification Search
CPC ..... A47B 3/14; A47B 2003/145; A47B 2200/0036
See application file for complete search history.

(56) References Cited

U.S. PATENT DOCUMENTS

| | | | | |
|---|---|---|---|---|
| 7,758,113 | B2 | 7/2010 | Hanusiak et al. | |
| 8,205,937 | B2 | 6/2012 | Rivera, Jr. et al. | |
| 8,479,667 | B2 | 7/2013 | Rivera, Jr. et al. | |
| 9,297,395 | B2 | 3/2016 | Rivera et al. | |
| 9,474,365 | B2 * | 10/2016 | Smith | F16F 13/002 |
| 9,629,451 | B2 * | 4/2017 | Harper | A47B 3/083 |
| D802,945 | S | 11/2017 | Rivera, Jr. et al. | |
| D836,928 | S * | 1/2019 | Samikkannu | A47C 13/00 D6/337 |
| 10,238,205 | B2 | 3/2019 | Dickey et al. | |
| D856,727 | S | 8/2019 | Rajkiewicz et al. | |
| 10,531,741 | B2 | 1/2020 | Rajkiewicz et al. | |
| RE47,955 | E | 4/2020 | Rivera et al. | |
| D893,932 | S | 8/2020 | Rajkiewicz et al. | |
| 10,939,757 | B1 | 3/2021 | Samikkannu et al. | |
| RE48,884 | E | 1/2022 | Samikkannu et al. | |

(Continued)

*Primary Examiner* — David R Dunn
(74) *Attorney, Agent, or Firm* — HONIGMAN LLP; Eric J. Sosenko; Jonathan P. O'Brien

(57) ABSTRACT

A table assembly includes a frame, a tabletop, and a multi-stage deployment mechanism. A first portion of the frame supports a first portion of the table top and is pivotable relative to a second portion of the frame that supports a second portion of the tabletop. The table assembly is movable from a use position to an intermediate position, to a folded position beyond the intermediate position, and to a cleaning position between the use position and the intermediate position. The multi-stage deployment mechanism is operable to resist movement of the table assembly toward the use position and includes a first stage that is engaged at the intermediate position to resist movement from the intermediate position toward the use position and a second stage that is engaged at the cleaning position to resist movement from the cleaning position toward the use position.

21 Claims, 25 Drawing Sheets

(56) References Cited

U.S. PATENT DOCUMENTS

| | | | | |
|---|---|---|---|---|
| D946,335 | S | 3/2022 | Samikkannu et al. | |
| 11,412,848 | B2 | 8/2022 | Samikkannu et al. | |
| D1,000,182 | S | 10/2023 | Samikkannu et al. | |
| D1,020,340 | S | 4/2024 | Samikkannu et al. | |
| RE49,984 | E | 5/2024 | Samikkannu et al. | |
| 2005/0161984 | A1* | 7/2005 | Bue | A47B 3/14<br>297/157.1 |
| 2011/0177869 | A1* | 7/2011 | Yoshimura | F16F 15/123<br>464/61.1 |

* cited by examiner

FOLDABLE TABLE WITH LOCKING MECHANISM

CROSS REFERENCE TO RELATED APPLICATION

The present application claims the filing benefits of U.S. provisional application Ser. No. 63/651,603, filed May 24, 2024, which is hereby incorporated herein by reference in its entirety.

TECHNICAL FIELD

This disclosure relates to a foldable table, and more particularly to a foldable table with a deployment mechanism and locking mechanism.

BACKGROUND

It is known to provide a foldable table for use in flexible and multi-purpose spaces, such as school cafeterias, classrooms, libraries, food courts, and hospitals, where furniture may frequently be moved to adjust layout or removed for storage. Typically, these foldable tables are relatively large and heavy, making it difficult and dangerous to control adjustment of the tables between folding positions. For example, these tables may frequently open or unfold in a rapid and uncontrollable manner, risking impact with a user or objects in the environment and/or pinching of the user's hands between table components.

SUMMARY

One aspect of the disclosure provides a table assembly including a frame, a tabletop, and a multi-stage deployment mechanism. The frame includes a first portion and a second portion. The first portion of the frame and the second portion of the frame are pivotable relative to one another about a pivot axis. The tabletop includes a first portion supported at the first portion of the frame and a second portion supported at the second portion of the frame. The table assembly is movable between a use position, an intermediate position, a folded position, and a cleaning position. In the use position, the first portion of the tabletop and the second portion of the tabletop extend generally parallel to one another and a ground surface. In the intermediate position, the first portion of the frame and the second portion of the frame are pivoted relative to one another about the pivot axis from the use position so that the first portion of the tabletop and the second portion of the tabletop extend at an oblique angle relative to the ground surface. In the folded position, the first portion of the frame and the second portion of the frame are pivoted relative to one another about the pivot axis from the use position beyond the intermediate position. In the cleaning position, the first portion of the frame and the second portion of the frame are pivoted relative to one another about the pivot axis between the use position and the intermediate position. The multi-stage deployment mechanism is operable to resist movement of the table assembly toward the use position. The multi-stage deployment mechanism includes a first stage and a second stage. With the table assembly moved to the intermediate position, the first stage is engaged to resist movement of the table assembly from the intermediate position toward the use position. With the table assembly moved to the cleaning position, the second stage is engaged to resist movement of the table assembly from the cleaning position toward the use position.

Implementations of the disclosure may include one or more of the following optional features. In some implementations, the multi-stage deployment mechanism includes a first biasing mechanism that includes the first stage and the second stage. In further implementations, the first stage is engaged as the table assembly is moved between the use position and the intermediate position and the first stage is not engaged as the table assembly is moved between the intermediate position and the folded position. In even further implementations, the first biasing mechanism includes a first end pivotally attached at the frame and a second end pivotally and slidably received along a slot of a yoke of a cylinder adapter bolted to the frame. The second end of the first biasing mechanism moves along the slot and engages an end of the slot to engage the first stage as the table assembly is moved from the folded position to the intermediate position.

In other further implementations, the second stage is engaged as the table assembly is moved between the use position and the cleaning position and the second stage is not engaged as the table assembly is moved between the cleaning position and the folded position. In other further implementations, the multi-stage deployment mechanism includes a second biasing mechanism. The second biasing mechanism includes a third stage that, with the table assembly moved to the use position, biases movement of the table assembly from the use position toward the intermediate position.

In some examples, the table assembly further includes a locking mechanism that engages to retain the table assembly in the folded position. Gravitational forces move table assembly from the folded position to the intermediate position responsive to disengagement of the locking mechanism.

In some aspects, the table assembly further includes a bench seat including a first portion supported at the first portion of the frame and a second portion supported at the second portion of the frame. In further aspects, the tabletop and the bench seat both include a wave shape.

In some implementations, the table assembly further includes a first stool seat supported at the first portion of the frame and a second stool seat supported at the second portion of the frame. In further implementations, a first leg extends from the first stool seat and a second leg extends from the second stool seat. The first leg and the second leg engage the ground surface with the table assembly in the use position. The first leg and the second leg remain substantially parallel to one another as the table assembly moves between the use position and the folded position. In other further implementations, the first stool seat and the second stool seat each respectively include one selected from the group consisting of (i) a circular seating surface and (ii) a rectangular seating surface.

In some examples, a mobility structure is disposed at the frame. The mobility structure does not engage the ground surface with the table assembly adjusted to the use position. The mobility structure engages the ground surface with the table assembly adjusted to the folded position to enable movement of the table assembly along the ground surface.

Another aspect of the disclosure provides a table assembly that includes a frame, a tabletop, a bench seat, and a multi-stage deployment mechanism. The frame includes a first portion and a second portion that are pivotable relative to one another about a pivot axis. A first portion of the tabletop is supported at the first portion of the frame and a second portion of the tabletop is supported at the second portion of the frame. The bench seat includes a first portion supported at the first portion of the frame and a second portion supported at the second portion of the frame. The table assembly is movable between a use position, an intermediate position, a folded position, and a cleaning position. In the use position, the first portion of the tabletop and the second portion of the tabletop extend generally parallel to one another and a ground surface. In the intermediate position, the first portion of the frame and the second portion of the frame are pivoted relative to one another about the pivot axis from the use position so that the first portion of the tabletop and the second portion of the tabletop extend at an oblique angle relative to the ground surface. In the folded position, the first portion of the frame and the second portion of the frame are pivoted relative to one another about the pivot axis from the use position beyond the intermediate position. In the cleaning position, the first portion of the frame and the second portion of the frame are pivoted relative to one another about the pivot axis between the use position and the intermediate position. The multi-stage deployment mechanism is operable to resist movement of the table assembly toward the use position. The multi-stage deployment mechanism includes a first biasing mechanism and a second biasing mechanism. The first biasing mechanism includes a first stage that, with the table assembly moved to the intermediate position, is engaged to resist movement of the table assembly from the intermediate position toward the use position, and a second stage that, with the table assembly moved to the cleaning position, is engaged to resist movement of the table assembly from the cleaning position toward the use position. The second biasing mechanism includes a third stage that, with the table assembly moved to the use position, biases movement of the table assembly from the use position toward the intermediate position. This aspect may include one or more of the following optional features.

In some implementations, the first stage is engaged as the table assembly is moved between the use position and the intermediate position. The first stage is not engaged as the table assembly is moved between the intermediate position and the folded position.

In some examples, the first biasing mechanism includes a first end pivotally attached at the frame and a second end pivotally and slidably received along a slot of a yoke of a cylinder adapter bolted to the frame. The second end of the first biasing mechanism moves along the slot and engages an end of the slot to engage the first stage as the table assembly is moved from the folded position to the intermediate position.

In some aspects, the second stage is engaged as the table assembly is moved between the use position and the cleaning position. The second stage is not engaged as the table assembly is moved between the cleaning position and the folded position.

In some implementations, the table assembly further includes a locking mechanism that engages to retain the table assembly in the folded position. Gravitational forces move the table assembly from the folded position to the intermediate position responsive to disengagement of the locking mechanism.

Yet another aspect of the disclosure provides a table assembly that includes a frame, a tabletop, and a multi-stage deployment mechanism. The frame includes a first portion and a second portion that are pivotable relative to one another about a pivot axis. The tabletop includes a first portion supported at the first portion of the frame and a second portion supported at the second portion of the frame. A first stool seat is supported at the first portion of the frame. A second stool seat is supported at the second portion of the frame. The table assembly is movable between a use position, an intermediate position, a folded position, and a cleaning position. In the use position, the first portion of the tabletop and the second portion of the tabletop extend generally parallel to one another and a ground surface. In the intermediate position, the first portion of the frame and the second portion of the frame are pivoted relative to one another about the pivot axis from the use position so that the first portion of the tabletop and the second portion of the tabletop extend at an oblique angle relative to the ground surface. In the cleaning position, the first portion of the frame and the second portion of the frame are pivoted relative to one another about the pivot axis between the use position and the intermediate position. The multi-stage deployment mechanism is operable to resist movement of the table assembly toward the use position. The multi-stage deployment mechanism includes a first stage and a second stage. With the table assembly moved to the intermediate position, the first stage is engaged to resist movement of the table assembly from the intermediate position toward the use position. The first stage is engaged as the table assembly is moved between the use position and the intermediate position and the first stage is not engaged as the table assembly is moved between the intermediate position and the folded position. With the table assembly moved to the cleaning position, the second stage is engaged to resist movement of the table assembly from the cleaning position toward the use position. The second stage is engaged as the table assembly is moved between the use position and the cleaning position and the second stage is not engaged as the table assembly is moved between the cleaning position and the folded position. This aspect may include one or more of the following optional features.

In some implementations, the multi-stage deployment mechanism includes a biasing mechanism. The biasing mechanism includes the first stage and the second stage. In further implementations, the biasing mechanism includes a first end pivotally attached at the frame and a second end pivotally and slidably received along a slot of a yoke of a cylinder adapter bolted to the frame. The second end of the biasing mechanism moves along the slot and engages an end of the slot to engage the first stage as the table assembly is moved from the folded position to the intermediate position.

In some examples, the table assembly further includes a locking mechanism that engages to retain the table assembly in the folded position. Gravitational forces move the table assembly from the folded position to the intermediate position responsive to disengagement of the locking mechanism.

In some aspects, a first leg extends from the first stool seat and a second leg extends from the second stool seat. The first leg and the second leg engage the ground surface with the table assembly in the use position. The first leg and the second leg remain substantially parallel to one another as the table assembly moves between the use position and the folded position.

In some implementations, the first stool seat and the second stool seat each respectively include one selected from the group consisting of (i) a circular seating surface and (ii) a rectangular seating surface.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1:
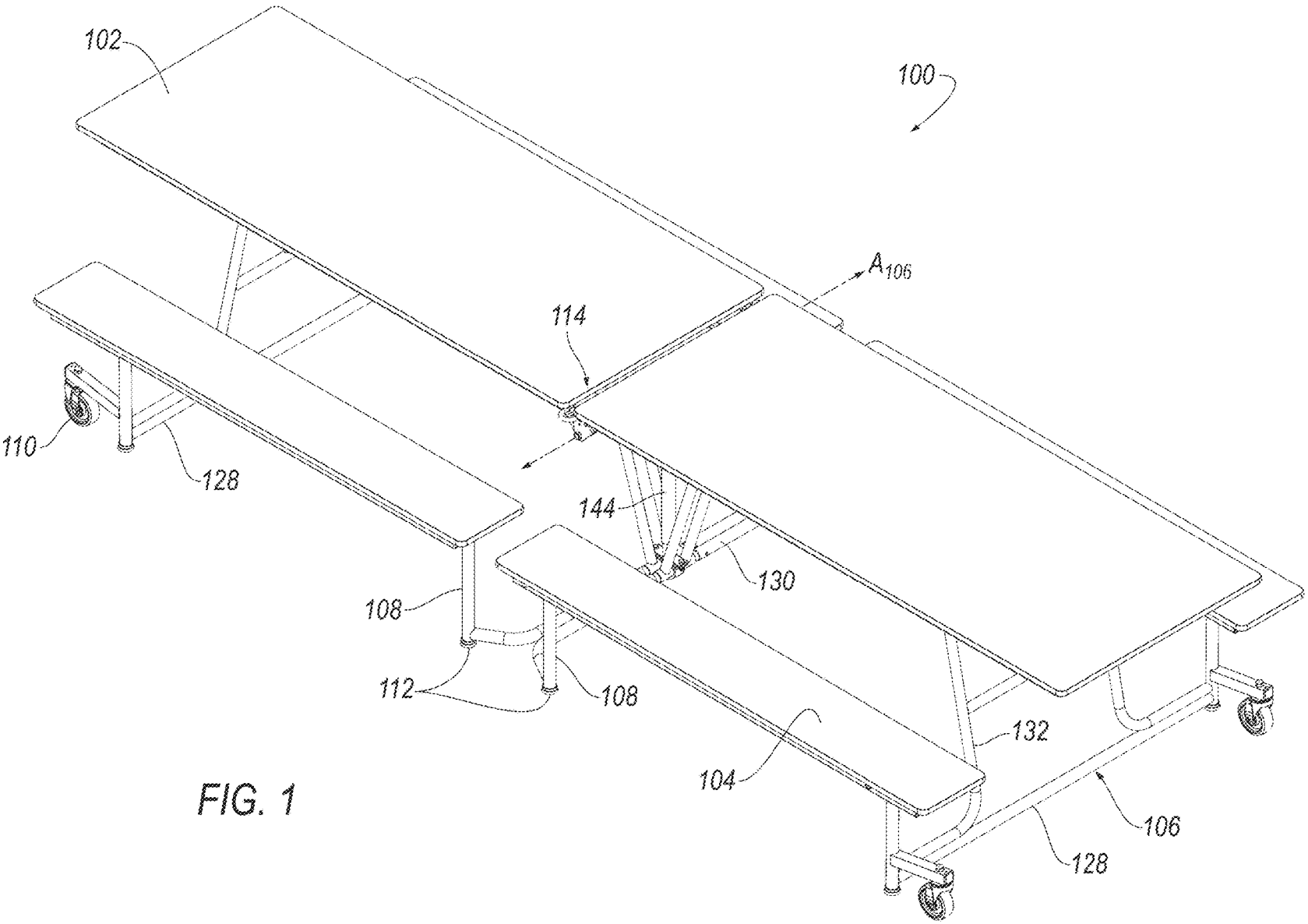
FIGS. 1-3 are views of a table assembly having bench seats and in an unfolded or use position.

Referring to FIGS. 1-10, a table assembly 100 includes a tabletop 102 and a seat 104 supported at a frame 106. The frame 106 is foldable to adjust the table assembly 100 between at least a use position (FIG. 1), where the frame 106 is extended and the tabletop 102 and seat 104 are positioned for use by one or more users, and a non-use or storage or folded position (FIG. 4), where the frame 106 is folded for compact storage of the table assembly 100. The frame 106 includes a set of legs 108 that support the table assembly 100 at a ground surface 10 when the table assembly 100 is in the use position, and the frame 106 includes a mobility structure, such as a set of casters or wheels 110, that support the table assembly 100 and enable movement of the table assembly 100 along the ground surface 10 when the table assembly 100 is in the folded position. The legs 108 may include non-slip rubber feet 112 at ends of the legs 108 for preventing movement relative to the ground surface 10 and the casters 110 may be lockable to prevent movement of the table assembly 100. The table assembly 100 may utilize characteristics of the tables described in U.S. Pat. Nos. 8,205,937; 8,479,667; 9,297,395; 10,939,757; 11,412,848; and/or RE47,955, which are hereby incorporated herein by reference in their entireties.

Figure 7:
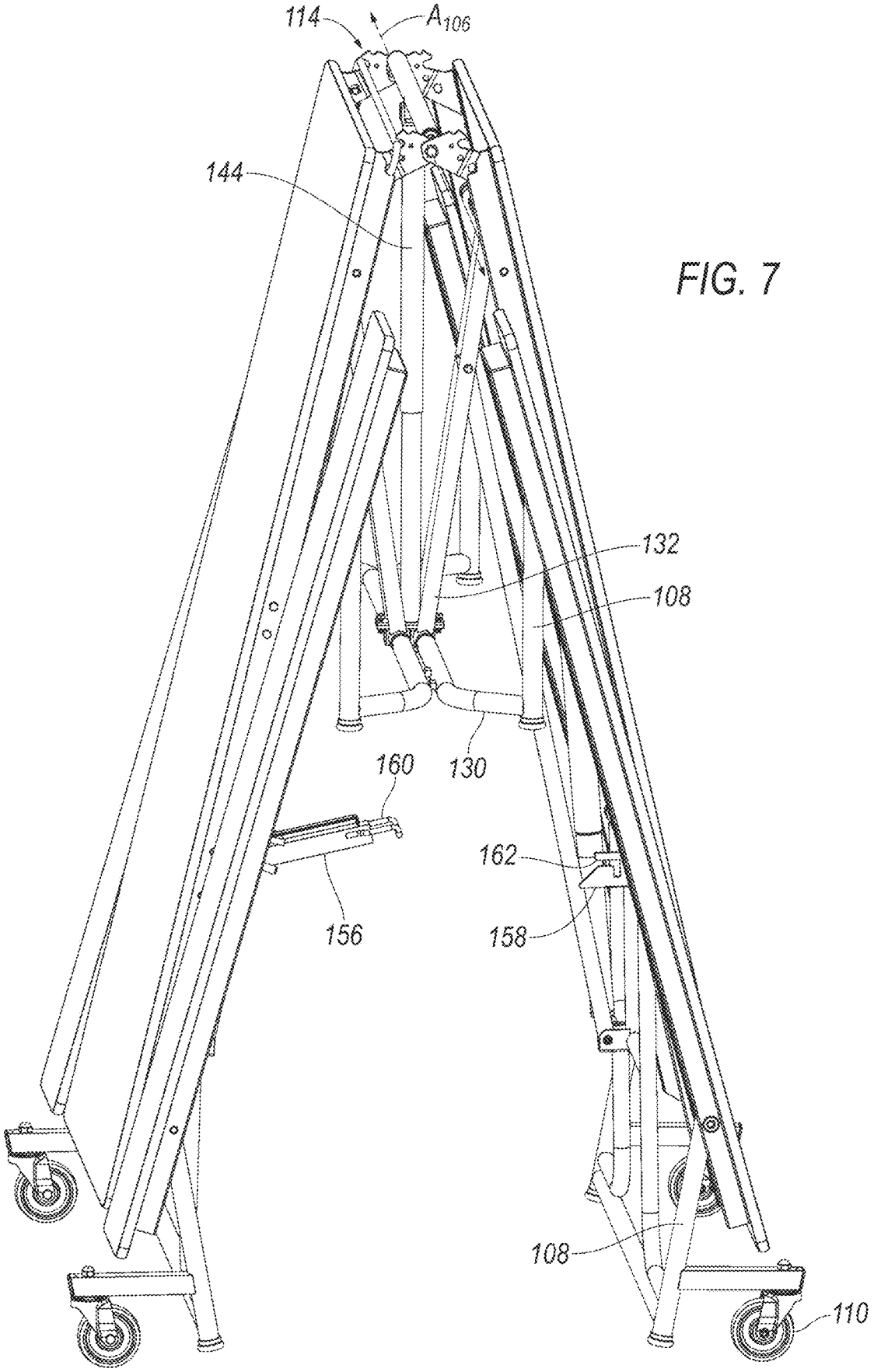
FIG. 7 is a perspective view of the table assembly in an intermediate position with the locking mechanism released.
Figure 8:
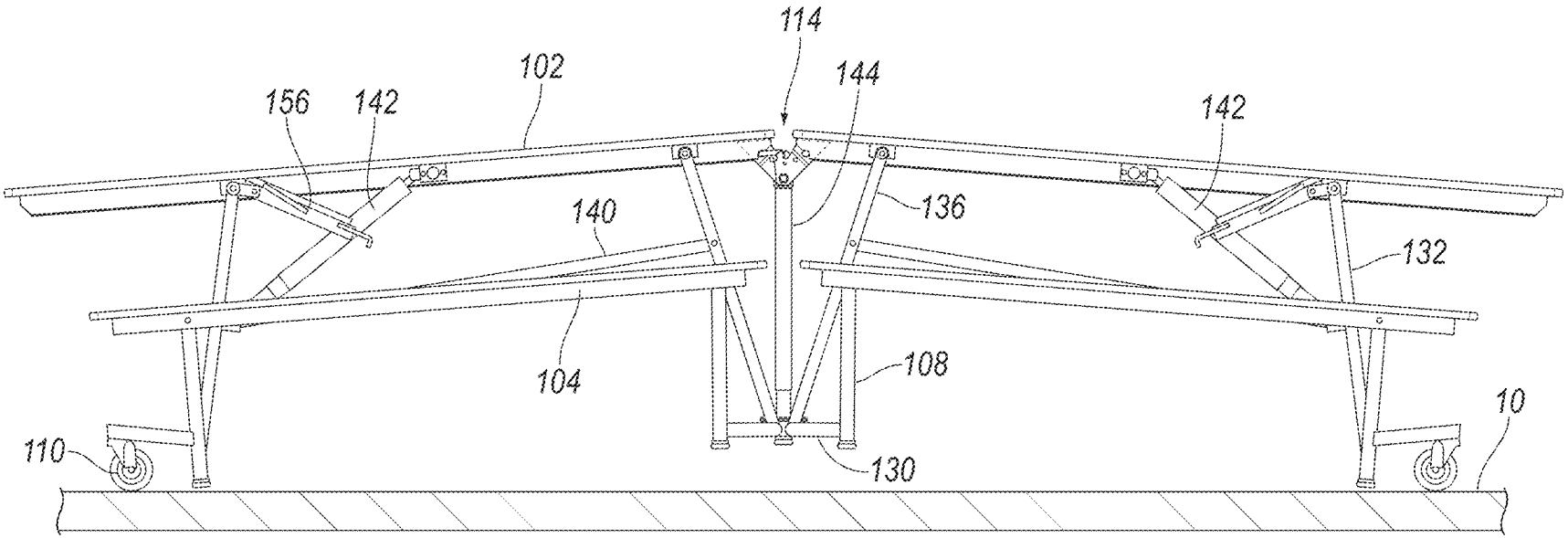
FIG. 8 is an environmental view of the table assembly in a tilted or cleaning or safety position.

As described below, the table assembly 100 is equipped with a deployment mechanism configured to dampen movement of the table assembly 100 from the folded position toward the use position and to assist a user in moving the table assembly 100 from the use position toward the folded position. Further, the table assembly 100 is equipped with a locking mechanism (FIGS. 5A and 5B) for securing the table assembly 100 in the folded position. With the locking mechanism released, the deployment mechanism may preclude or resist movement of the table assembly 100 toward the use position so that the user may control the table assembly 100 along its range of motion by manually moving the table assembly 100 toward the use position. For example, upon release of the locking mechanism, gravitational forces may move the table assembly 100 slightly toward the use position and the deployment mechanism may hold the table assembly 100 in an intermediate or released position (FIG. 7). Moreover, the deployment mechanism may be a multi-stage deployment mechanism that is configured to hold the table assembly 100 in one or more positions between the use position and the folded position, such as a tilted or cleaning or safety position (FIG. 8) that stops movement of the table assembly 100 from the folded position before reaching the use position and allows for easier cleaning of the table surfaces. Thus, the user may easily control movement of the table assembly 100 between folding positions with a reduced risk of injury and without requiring excessive force to deploy or fold the table assembly 100.

The frame 106 includes a first portion or half 106*a* that supports a first portion or surface 102*a* of the tabletop 102 and the frame 106 includes a second portion or half 106*b* that supports a second portion or surface 102*b* of the tabletop 102. The first portion 106*a* of the frame 106 further supports a first portion or bench 104*a* of the seat 104 along a first side of the first surface 102*a* and a second portion or bench 104*b* along an opposing second side of the first surface 102*a*. Similarly, the second portion 106*b* of the frame 106 supports a third portion or bench 104*c* of the seat 104 along a first side of the second surface 102*b* and a fourth portion or bench 104*d* along an opposing second side of the second surface 102*b*. The bench seats 104*a-d* are each configured to support multiple users sitting at once. As will become apparent below, the first portion 106*a* of the frame 106 and the second portion 106*b* of the frame 106 may be substantially similar to one another.

A hinge mechanism 114 pivotally connects the first portion 106*a* and the second portion 106*b* of the frame 106 to one another at a central portion of the table assembly 100. For example, the hinge mechanism 114 includes a pivot element or axle 116 that defines a pivot axis $A_{106}$ of the frame 106, with a first hinge plate 118*a* pivotally attaching the first portion 106*a* of the frame 106 to the pivot axle 116 and a second hinge plate 118*b* pivotally attaching the second portion 106*b* of the frame 106 to the pivot axle 116. Accordingly, the first portion 106*a* of the frame 106 and the second portion 106*b* of the frame 106 are pivotable relative to one another about the pivot axis $A_{106}$. The pivot axis $A_{106}$ may extend substantially perpendicular to a longitudinal axis $A_{102a}$ of the first surface 102*a* of the tabletop 102 and a longitudinal axis $A_{102b}$ of the second surface 102*b* of the tabletop 102. As discussed below, the first hinge plate 118*a* and the second hinge plate 118*b* include respective notches 120 configured to receive a pin or locking bar 122 to preclude pivoting of the frame 106 about the pivot axis $A_{106}$ and lock the table assembly 100 in one or more pivot positions (FIGS. 9A-9D).

Figure 2:
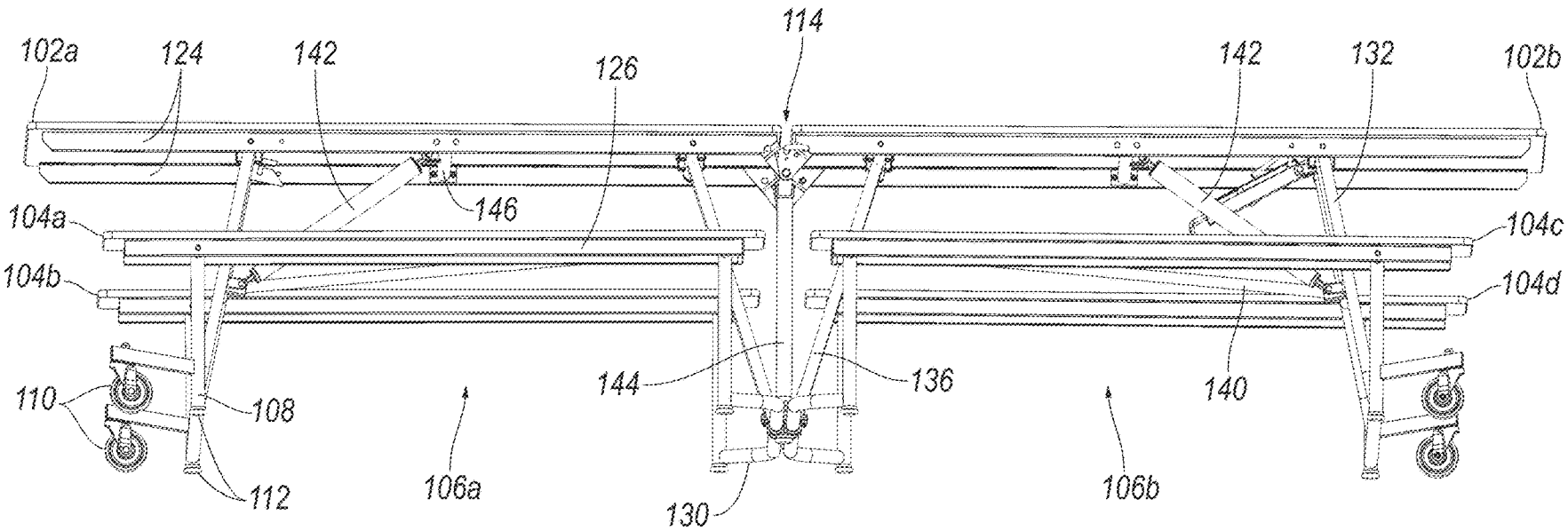
Figure 3:
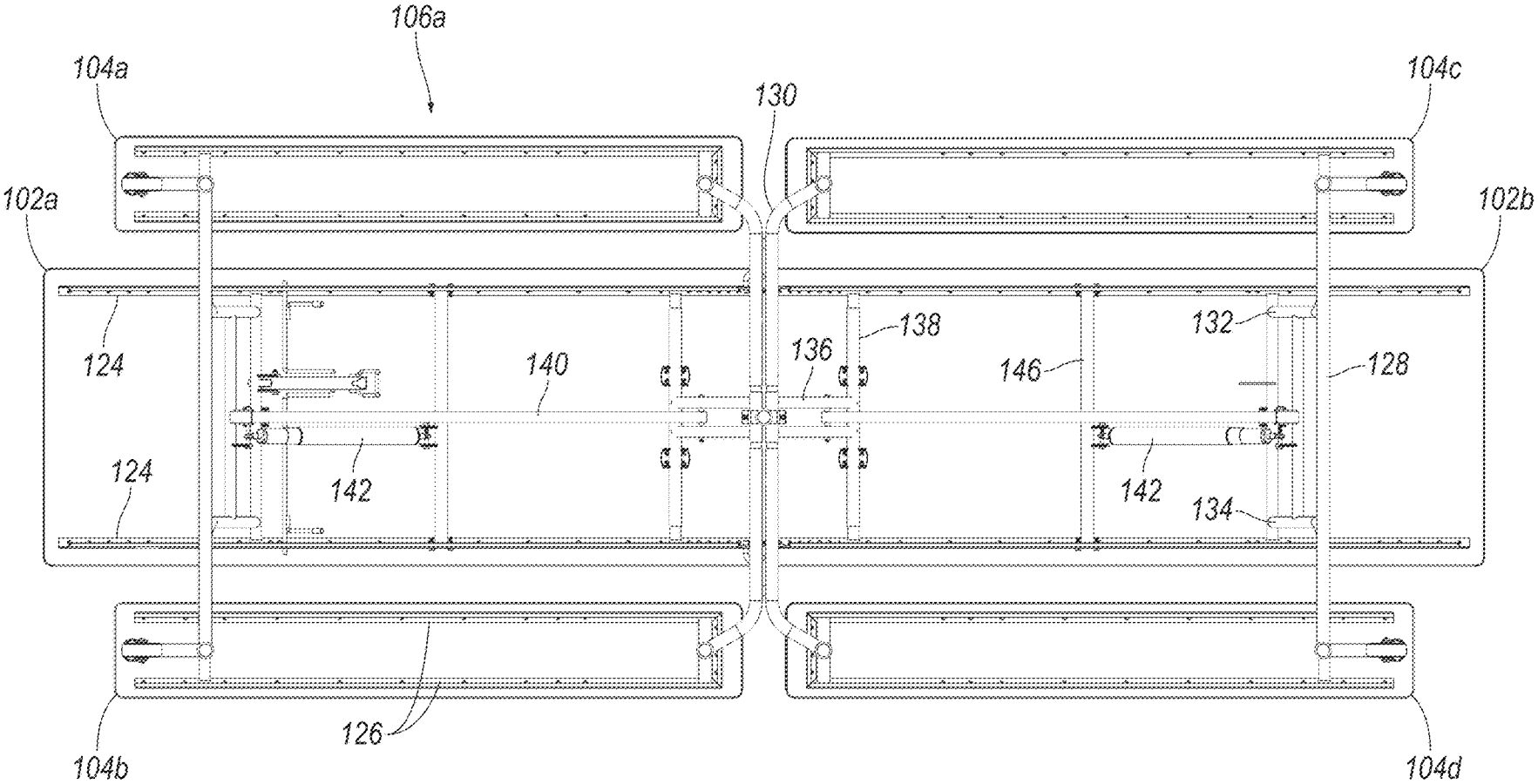
Figure 4:
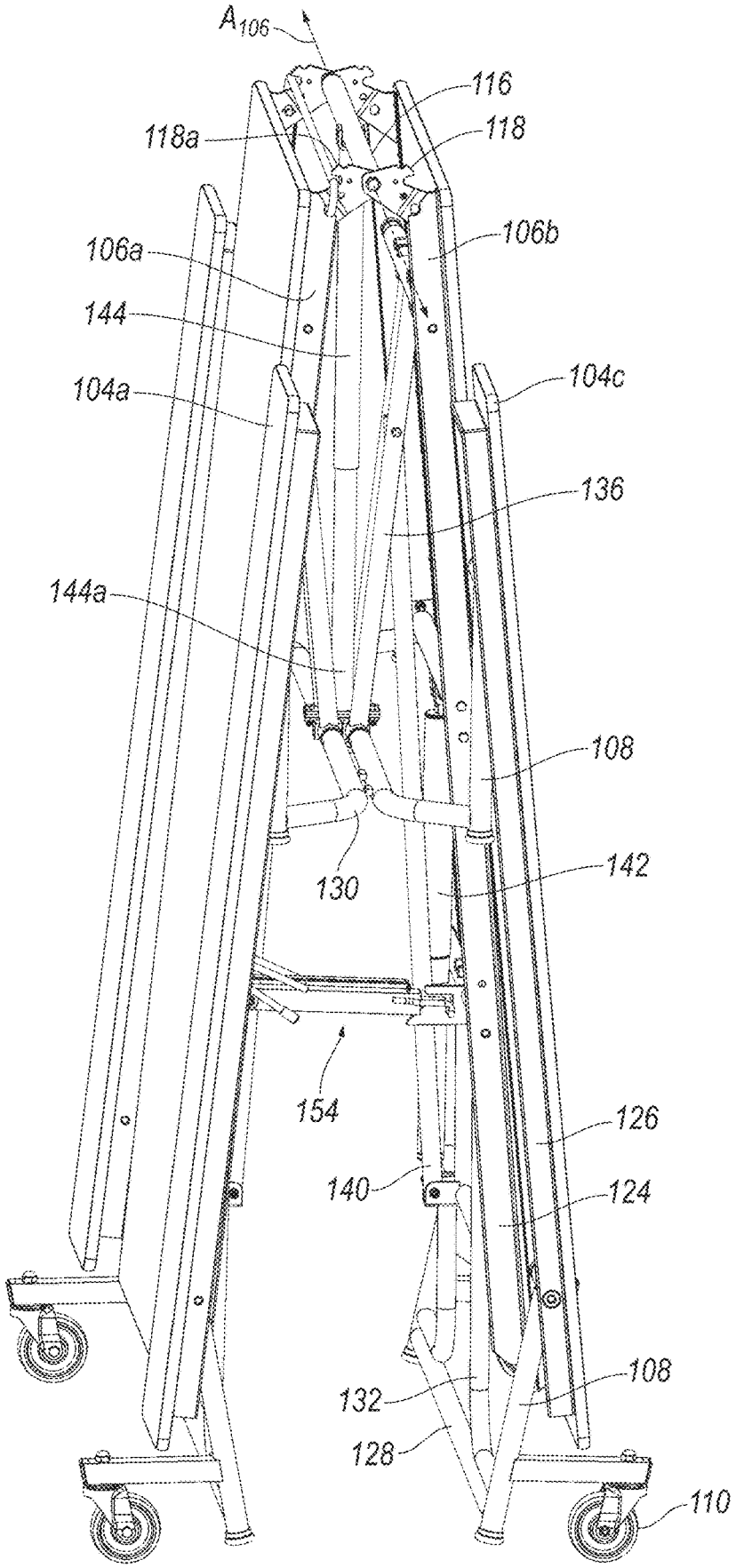
FIG. 4 is a perspective view of the table assembly in a folded position.

Referring to FIGS. 2-4, each portion 106*a*, 106*b* of the frame 106 includes an apron formed from a set of rails 124 extending parallel to one another and mounted to a lower surface along opposing sides of the tabletop portions 102*a*, 102*b*. The rails 124 at the first tabletop surface 102*a* are pivotally attached to the rails 124 at the second tabletop surface 102*b* via the hinge mechanism 114. Similarly, each bench 104 includes a set of rails 126 extending parallel to one another and mounted to a lower surface along opposing sides of the bench 104. The legs 108 are pivotally attached to the rails 126 at the respective benches 104. For example, legs 108 at the outer ends of the benches 104 at opposing ends of the table assembly 100 are pivotally attached at a fixed position along the rails 126 and legs 108 at inner ends of the benches 104 at the central portion of the table assembly 100 are pivotally attached and slidable along the rails 126 to accommodate movement of the table assembly 100 between the use position and the folded position.

Outer stretchers 128 extend between the legs 108 at the outer ends of the table assembly 100 and inner stretchers 130 extend between the legs 108 at the central portion of the table assembly 100. Outer struts or uprights 132 extend from the outer stretchers 128 and are pivotally attached to the rails 124 at the tabletop 102, such as by way of a pivotable outer cross-rail 134 extending between the rails 124. In other words, the outer cross-rail 134 is pivotably attached between the rails 124 and the outer uprights 132 extend between the cross-rail 134 and the stretchers 128 that are attached to the outer legs 108. Similarly, inner struts or uprights 136 extend from the inner stretchers 130 and are pivotally attached to the rails 124 at the central portion of the table assembly 100 by way of a pivotable inner cross-rail 138. Further, the inner stretcher 130 of the first portion 106*a* of the frame 106 is attached to the inner stretcher 130 of the second portion 106*b* of the frame 106. Respective braces 140 extend between and are pivotally attached to the outer upright 132 and the inner upright 136 at both the first portion 106*a* and the second portion 106*b* of the frame 106.

Figure 9A:
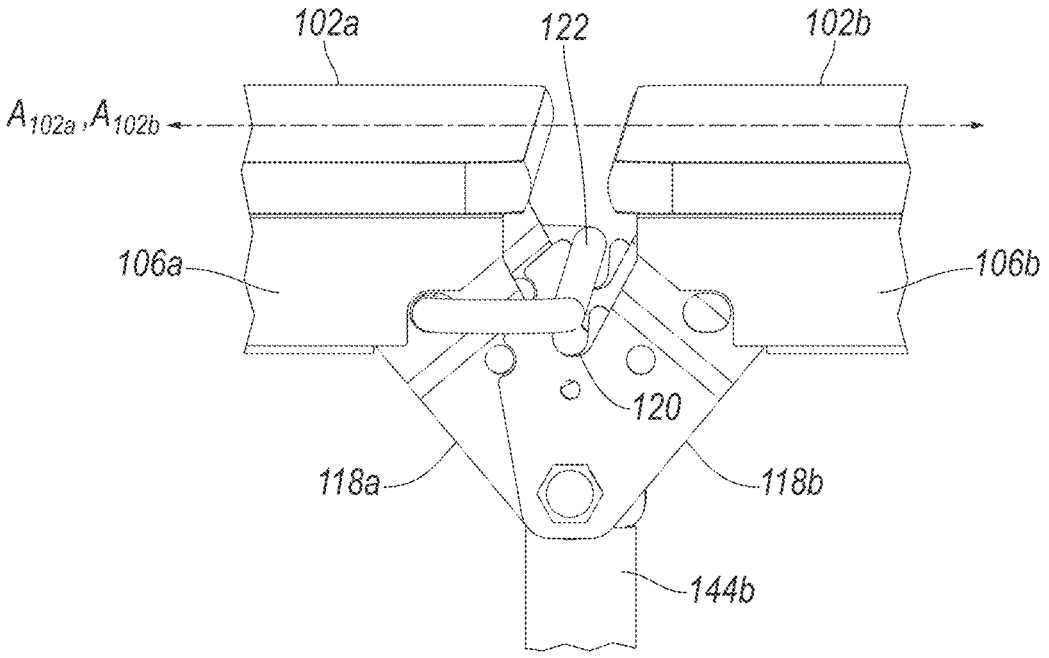
FIGS. 9A-9D are enlarged views of a hinge mechanism of the table assembly as the table assembly is moved between the use position (FIG. 9A), the folded position (FIG. 9B), the intermediate position (FIG. 9C), and the cleaning position (FIG. 9D)

As shown in FIGS. 1, 2, and 9A, with the table assembly 100 in the use position, the first surface 102*a* of the tabletop 102 and the second surface 102*b* of the tabletop 102 extend generally parallel to one another in a flat or horizontal position. That is, the longitudinal axis $A_{102a}$ of the first surface 102*a* extends parallel to the longitudinal axis $A_{106b}$ of the second surface 102*b* and the ground surface 10. Likewise, the benches 104 extend generally parallel to one another and the tabletop 102 in a flat or horizontal position so that users may sit at the benches 104 when using the upper surfaces of the tabletop 102, such as for an eating or work surface. The legs 108 support the table assembly 100 in the use position with the feet 112 engaging the ground surface 10 to preclude movement of the table assembly 100 along the ground surface 10. In the use position, the outer stretchers 128 and the inner stretchers 130 extend at or near the ground surface 10 to allow for easier entry and exit of the users sitting at the table assembly 100. That is, the outer stretcher 128 passes between the outer uprights 132 and the legs 108 along the ground surface 10 and the inner stretcher 130 passes between the inner uprights 136 and the legs 108 along the ground surface 10 to allow for a substantially clear passage between the tabletop 102 and the benches 104.

Referring to FIGS. 4, 5A, 5B and 9B, when the table assembly 100 is moved from the use position to the folded position, the first portion 106*a* of the frame 106 and the first surface 102*a* of the tabletop 102 are pivoted relative to the second portion 106*b* of the frame 106 and the second surface 102*b* of the tabletop 102 about the pivot axis $A_{106}$ to position the first surface 102*a* and the second surface 102*b* in generally upright or vertical positions relative to the ground surface 10 and to substantially fold or collapse the frame 106 between the portions of the tabletop 102. The benches 104 move according to movement of the frame 106 and tabletop 102 and thus are also in generally upright or vertical positions in the folded position. In some examples, the tabletop surfaces 102*a*, 102*b* and/or the respective benches 104 may extend at an oblique angle relative to one another in the folded position, such that an angle $\theta_{102a}$ between the first surface 102*a* and the ground surface 10 is an acute angle and equal to an angle $\theta_{102b}$ between the second surface 102*b* and the ground surface 10.

As the table assembly 100 moves toward the folded position, legs 108 at the central portion of the table assembly 100 are lifted off the ground surface 10 as the inner ends of the table surfaces 102*a*, 102*b* move vertically upward. The legs 108 at the outer ends of the table assembly 100 also move away from the ground surface 10 as each portion of the table assembly 100 tilts and is supported at the respective casters 110 attached to the outer legs 108. As the outer ends of the table assembly 100 move toward one another (e.g., via the casters 110 moving along the ground surface 10), the outer uprights 132 pivot about the outer cross-members 134 to fold the outer stretchers 128 and the outer uprights 132 toward the tabletop 102 and the outer legs 108 pivot relative to the rails 126 at the benches 104 to fold the legs 108 toward the benches 104. Meanwhile, the legs 108 at the inner ends of the benches 104 at the central portion of the table assembly 100 pivot relative to the benches 104 and slide relative to the rails 126 toward the outer ends of the benches 104 to fold the legs 108 toward the benches 104. The legs 108 at the inner ends of the benches 104 slide along the rails 126 of the benches 104 to accommodate the different degree of rotation of the outer uprights 132 about the outer cross-members 134 compared to the rotation of the inner uprights 136 about the inner cross-members 138 as the table assembly 100 moves between the use position and the folded position. For example, when the table assembly 100 moves from the use position to the folded position, the outer uprights 132 may rotate 68 degrees or less about the outer cross-members 134 while the inner uprights 136 may rotate 92 degrees or more about the inner cross-members 138.

To control movement of the table assembly 100 between the use position and the folded position, a multi-stage deployment mechanism of the table assembly 100 is configured to bias the table assembly 100 toward the folded position to assist folding of the table assembly 100 from the use position and to dampen or resist unfolding of the table assembly 100 toward the use position. In the illustrated example of FIGS. 1-10, the multi-stage deployment mechanism includes a first cylinder or biasing mechanism 142 at each of the first portion 106*a* of the frame 106 and the second portion 106*b* of the frame 106, and a second or central cylinder or biasing mechanism 144 at the central portion of the table assembly 100. As discussed further below, the first biasing mechanism 142 and the central biasing mechanism 144 may cooperatively enable various stages of the deployment mechanism that engage or activate as the table assembly 100 moves between the use position and the folded position to provide varying biasing forces throughout movement of the table assembly 100. For example, the biasing mechanisms include gas cylinders or torque bars or compression springs accommodated within telescoping cylindrical housings. Use of compression springs within telescoping cylindrical housings may allow the user to leave the table assembly 100 in the use position for longer periods of time without significant degradation to the biasing force of the biasing mechanism.

Figures 6A, 6B:
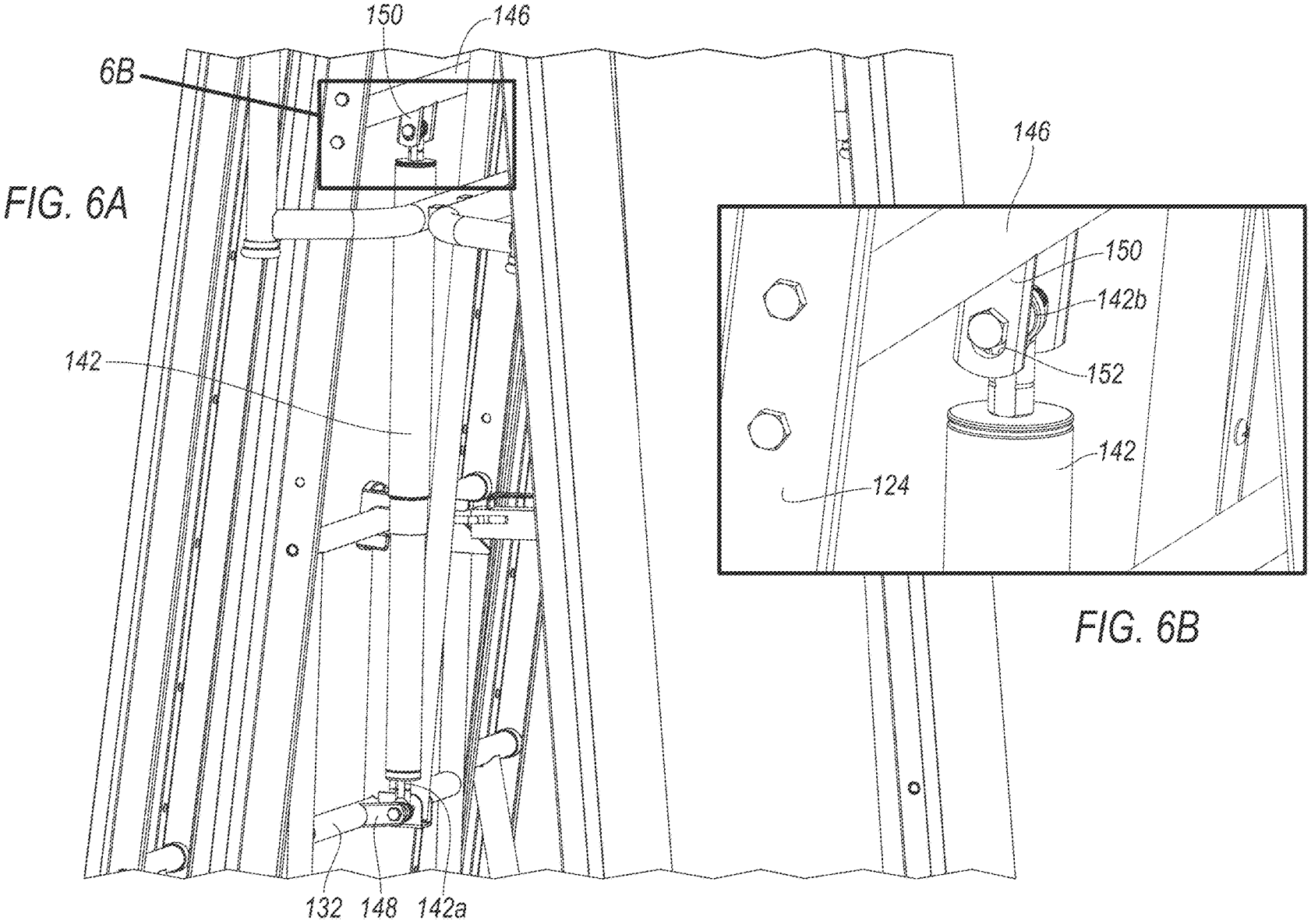
FIG. 6A is a partial view of the table assembly.
FIG. 6B is an enlarged view of area 6B in FIG. 6A.

As shown in FIGS. 6A and 6B, the first biasing mechanism 142 at each portion 106*a*, 106*b* of the frame 106 extends between the respective outer upright 132 and a central cross-member or cylinder adapter 146 extending between the rails 124, with the first biasing mechanism 142 attaching between a yoke 148 of the outer upright 132 and a yoke 150 of the cylinder adapter 146. The cylinder adapter 146 may be bolted on or otherwise non-rotatably attached to the rails 124. Moreover, a mounting position of the cylinder adapter 146 along the rails 124 may be adjusted, such as based on a length of the tabletop 102, a length of the first biasing mechanism 142, a height of the table assembly 100, a desired biasing power of the first biasing mechanism 142 and the like. A first end 142*a* of the biasing mechanism 142 pivotally attaches at the outer upright 132 of the frame 106 and a second end 142*b* opposite the first end 142*a* pivotally and slidably attaches at the yoke 148 of the cylinder adapter 146. For example, a pin or bolt extends through the first end 142*a* of the first biasing mechanism 142 and the yoke 148 at the outer upright 132 to pivotally attach the first end 142*a* to the outer upright 132. The yoke 150 at the cylinder adapter 146 includes a slot 152 so that a pin or bolt extending through the second end 142*b* and the yoke 150 may slide along the slot 152 and allow pivoting of the second end 142*b* of the biasing mechanism 142 relative to the cylinder adapter 146.

Thus, with the table assembly 100 in the folded position, the second end 142*b* of the biasing mechanism 142 may be at or near one end of the slot 152 and disengaged from the frame 106, that is not applying a biasing force at the frame 106. As the table assembly 100 moves from the folded position, the second end 142*b* moves along the slot 152 and engages the other end of the slot 152 to activate the biasing mechanism 142 and transfer biasing force to the frame 106 (FIGS. 6A and 6B). As discussed further below, the first biasing mechanism 142 at each portion 106*a*, 106*b* of the frame 106 expands as the table assembly 100 moves from the use position toward the folded position to urge the table assembly 100 toward the folded position, with the first end 142*a* pivoting relative to the yoke 148 at the outer upright 132 and with the second end 142*b* pivoting and/or sliding relative to the yoke 150 at the cylinder adapter 146 to accommodate movement of the table assembly 100.

The central biasing mechanism 144 is attached to both the first portion 106*a* of the frame 106 and the second portion 106*b* of the frame 106, as well as the hinge mechanism 114. For example, the central biasing mechanism 144 includes a first end 144*a* that attaches to the inner stretchers 130 and/or the inner uprights 136 at the central portion of the table assembly 100 and a second end 144*b* opposite the first end 144*a* that attaches to the pivot axle 116. Attachment of the central biasing mechanism 144 may allow for pivoting of the inner stretchers 130 and/or inner uprights 136 relative to the first end 144*a* during movement of the table assembly 100 between the use position and the folded position. As discussed further below, the central biasing mechanism 144 expands as the table assembly 100 moves from the use position toward the folded position to urge the table assembly 100 toward the folded position.

Figure 5A:
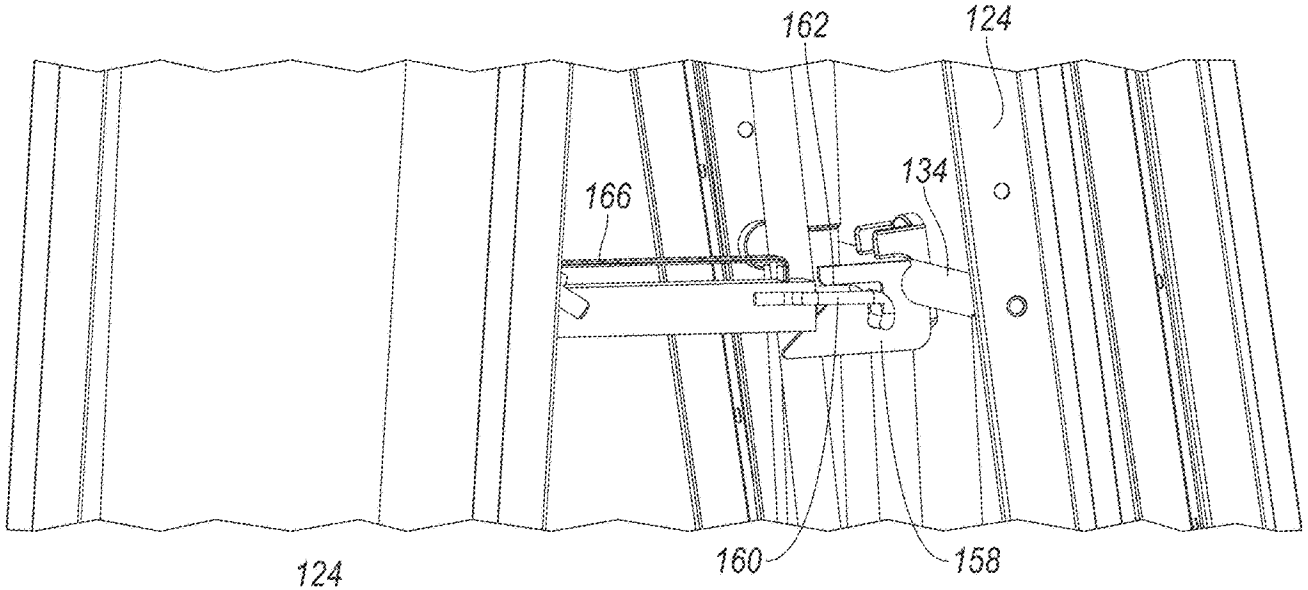
FIGS. 5A and 5B are partial views of the table assembly in the folded position, showing a locking mechanism of the table assembly securing the table assembly in the folded position.
Figure 5B:
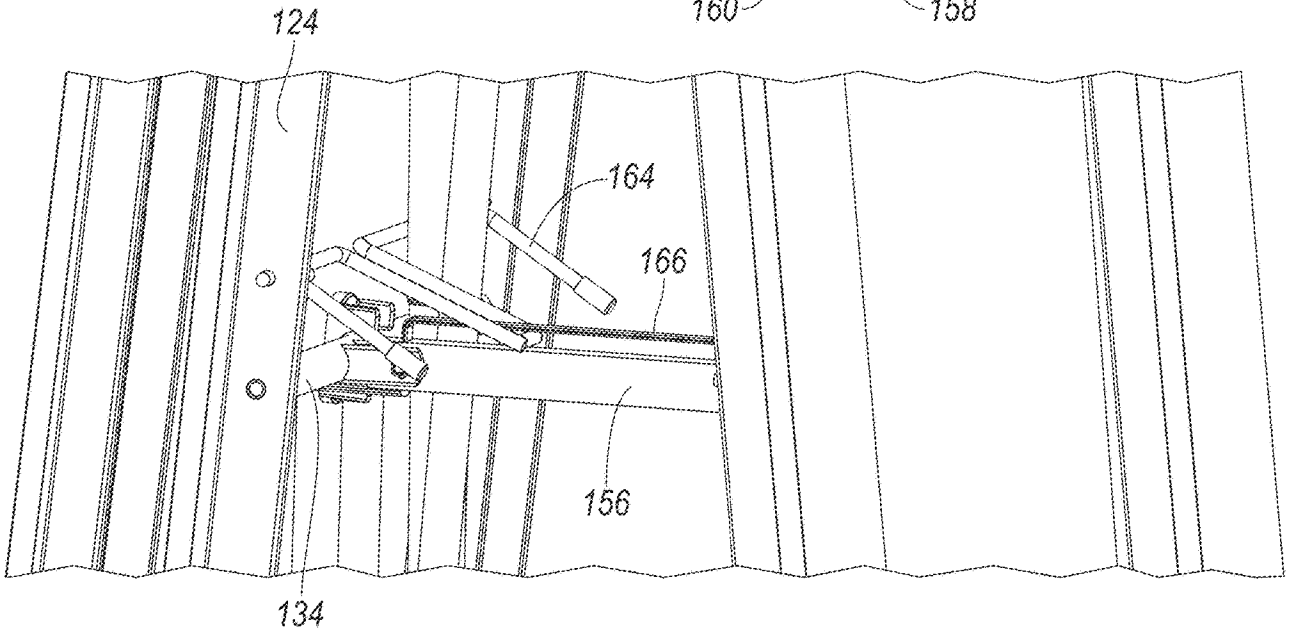

Referring to FIGS. 4, 5A, and 5B, the table assembly 100 further includes a locking mechanism 154 that engages to retain the table assembly 100 in the folded position. In the illustrated example, the locking mechanism 154 includes a striker bar 156 extending from the second portion 106*b* of the frame 106 and a keeper 158 disposed at the first portion 106*a* of the frame 106. For example, the striker bar 156 and the keeper 158 may be mounted at the respective outer cross-members 134 of the first portion 106*a* and the second portion 106*b* of the frame 106. With the table assembly 100 in the folded position and the locking mechanism 154 engaged, a retaining portion 160 of the striker bar 156 is received within a channel or recess 162 of the keeper 158. A handle or lifter 164 of the locking mechanism 154 is pivotally attached between the rails 124 of the first portion 106*a* of the frame 106 and extends through or between a rail 166 and the body of the striker bar 156.

To disengage the locking mechanism 154, a user may lift or pivot the handle 164 (e.g., counterclockwise in FIG. 5B), which causes the retaining portion 160 of the striker bar 156 to align with an opening in the channel 162 of the keeper 158. Because at least the first biasing mechanisms 142 of the multi-stage deployment mechanism are not engaged or activated when the table assembly 100 is in the folded position, pivoting the striker bar 156 (e.g., counterclockwise in FIG. 5B) so that the retaining portion 160 aligns with the opening in the channel 162 of the keeper 158 allows the retaining portion 160 to pull out of the channel 162 as gravitational forces move the two portions 106*a*, 106*b* of the frame 106 away from one another and the table assembly 100 moves to an intermediate or released position. In other words, gravitational forces move the table assembly 100 from the folded position to the intermediate position responsive to disengagement of the locking mechanism 154.

Figure 9B:
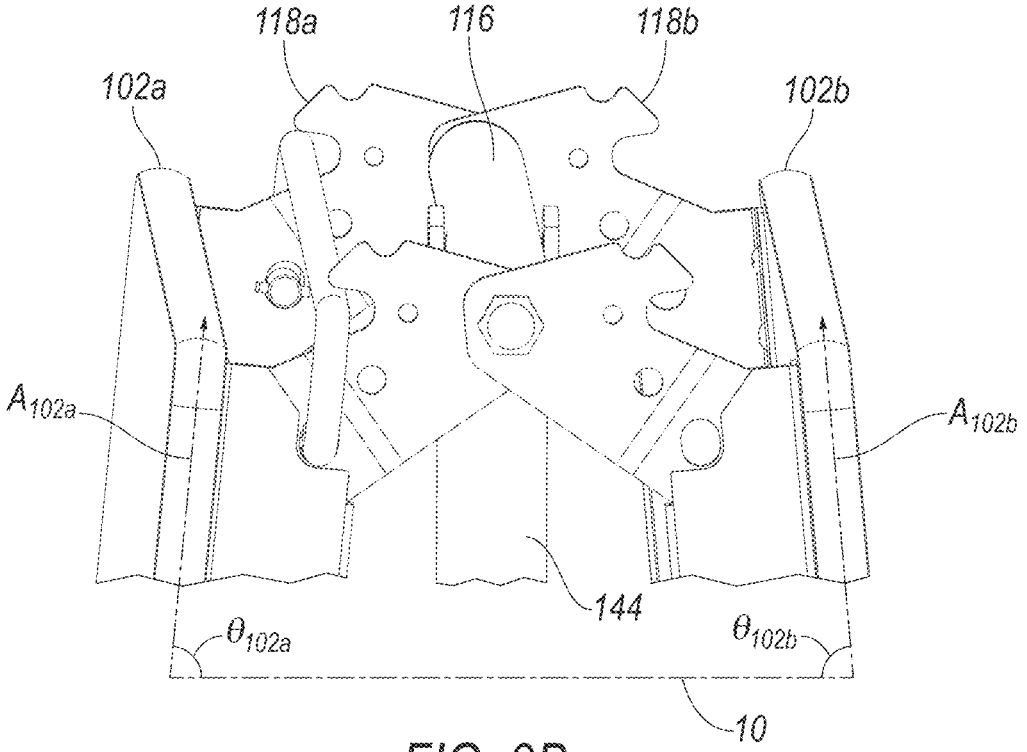
Figure 9C:
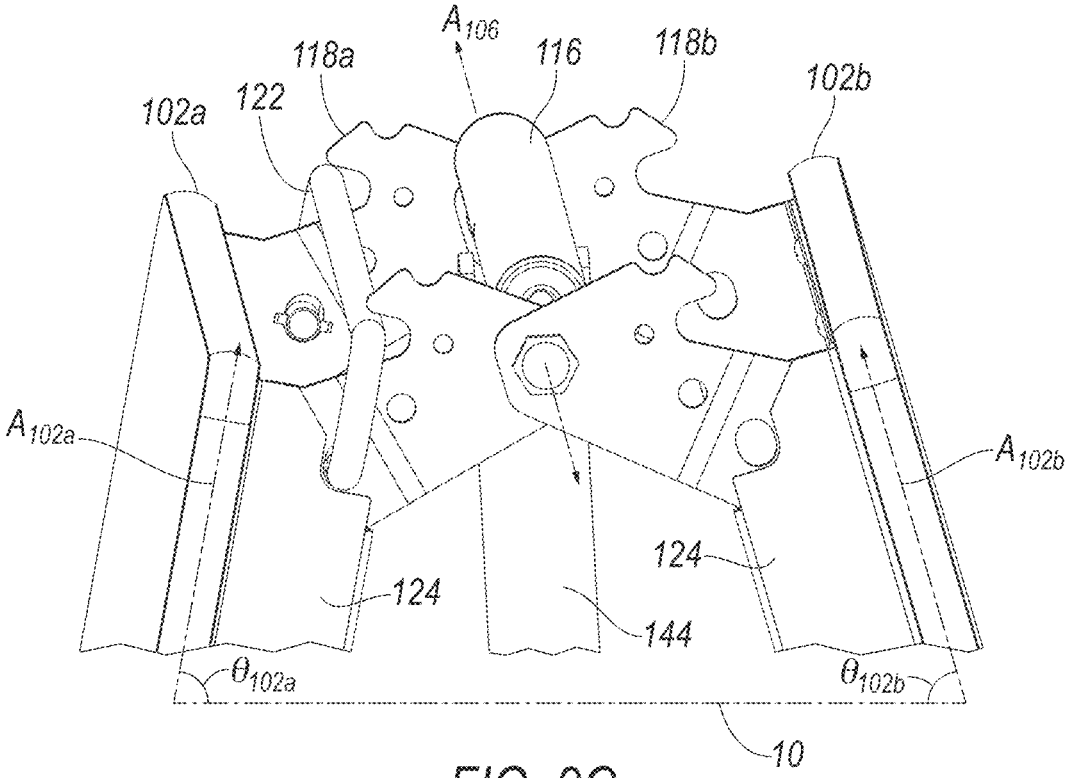
Figure 9D:
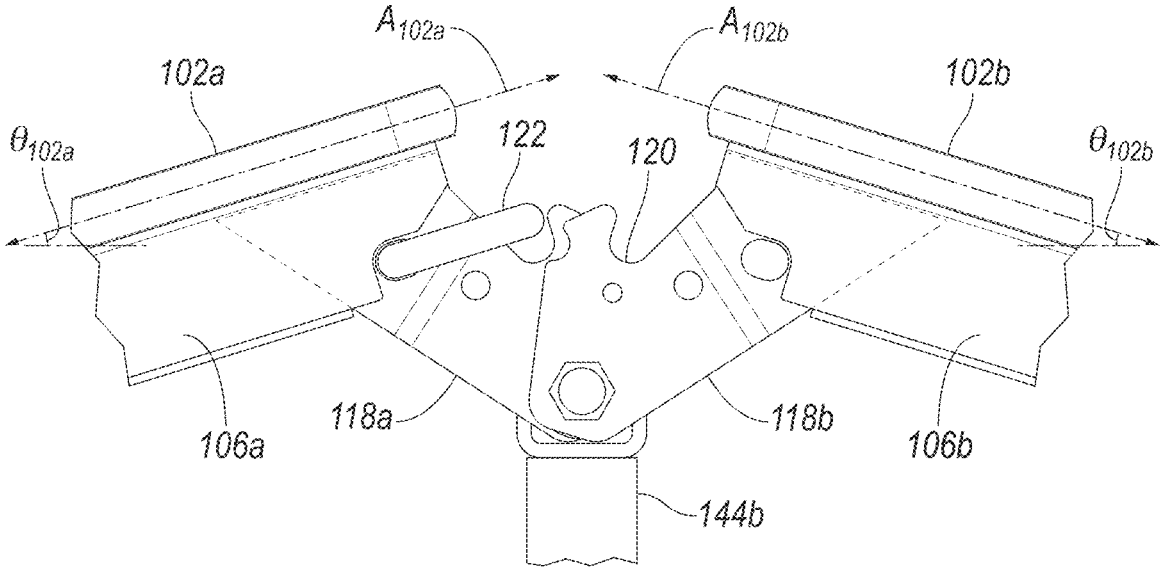
Figure 10:
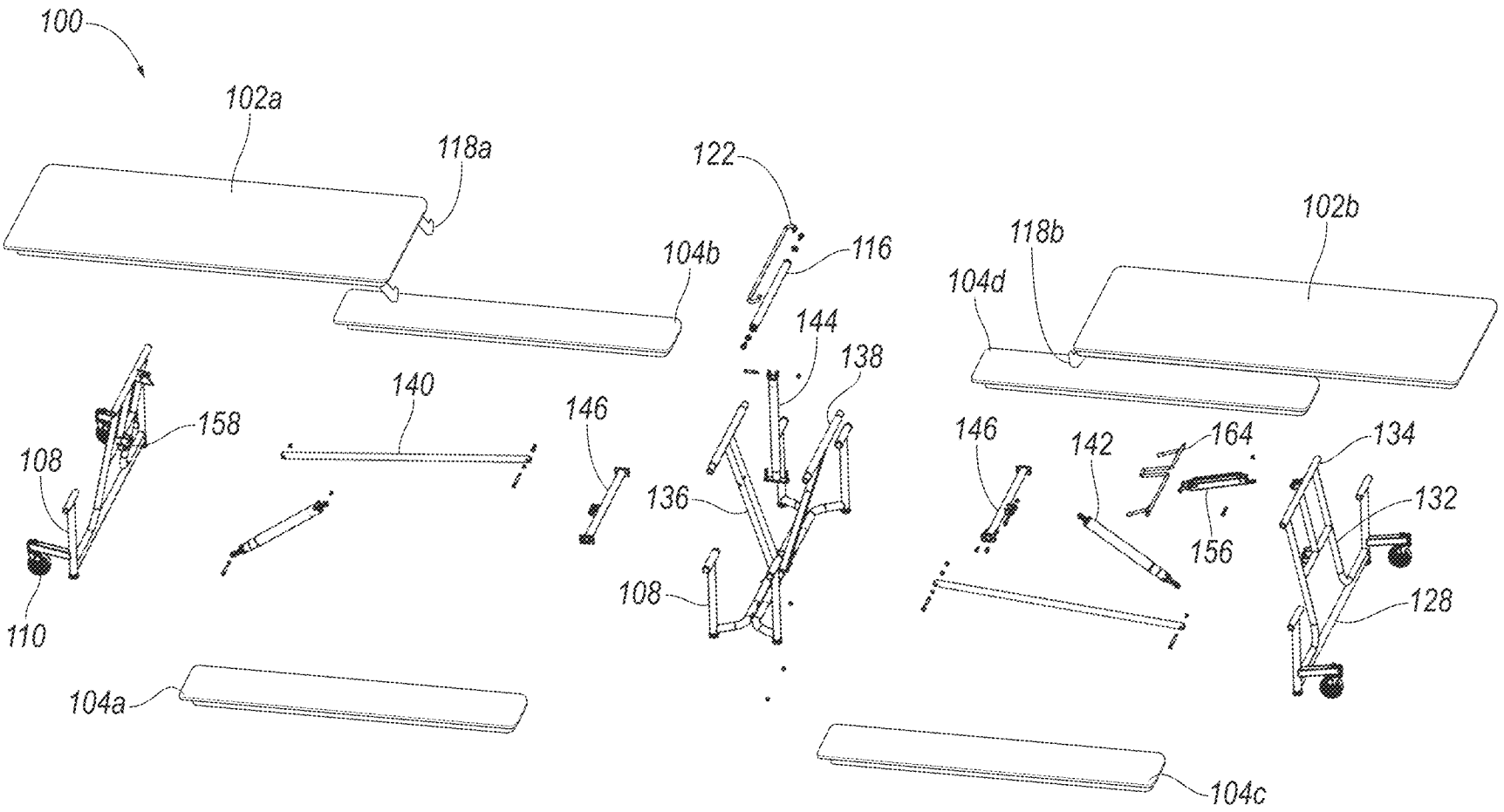
FIG. 10 is an exploded view of the table assembly.

As set forth above, the first biasing mechanism 142 is not engaged or activated with the table assembly 100 in the folded position and the locking mechanism 154 engaged (FIGS. 4 and 9B). When the locking mechanism 154 is disengaged, gravitational forces may cause the first portion 106*a* and the second portion 106*b* of the frame 106 to pivot slightly away from one another about the pivot axis $A_{106}$ of the hinge mechanism 114 to move the table assembly 100 to the intermediate position (FIGS. 7 and 9C). That is, the outer ends of the table assembly 100 move away from one another via the casters 110 along the ground surface 10, and the central portion of the table assembly 100 moves vertically downward toward the ground surface 10. For example, the outer ends of the table assembly 100 at the ground surface 10 may move about 19 inches away from each other as the table assembly 100 moves from the folded position to the intermediate position.

As the table assembly 100 approaches the intermediate position, the second end 142*b* of the biasing mechanism 142 engages the end of the slot 152 to engage or activate a first stage of the multi-stage deployment mechanism (FIGS. 6A and 6B). For example, with the first stage activated, a first compression spring of the first biasing mechanism 142 is engaged to resist movement of the table assembly 100 from the intermediate position toward the use position. The first stage of the multi-stage deployment mechanism may retain the table assembly 100 in the intermediate position until further manual input is provided by the user.

Thus, with the outer ends of the table assembly 100 at the ground surface 10 moved slightly away from each other and the inner ends or central portion of the table assembly 100 lowered toward the ground surface 10, the table assembly 100 may be positioned for the user to more easily apply force and move the table assembly 100 toward the use position. For example, the user may press downward on the inner ends of the tabletop surfaces 102 or the inner ends of the benches 104 to move the table assembly 100 toward the use position.

When the user manually moves the table assembly 100 from the intermediate position toward the use position (FIGS. 1-3 and 9A), such as by pushing downward on the benches 104 or the tabletop surfaces 102*a*, 102*b*, the first portion 106*a* and the second portion 106*b* of the frame 106 pivot relative to one another about the pivot axis $A_{106}$ of the hinge mechanism 114 with the first stage of the of the deployment mechanism dampening movement of the table assembly 100 toward the use position. That is, the outer ends of the table assembly 100 move further away from one another via the casters 110 along the ground surface 10, and the central portion of the table assembly 100 moves further vertically downward toward the ground surface 10. As the table assembly 100 approaches the tilted or cleaning or safety position (FIGS. 8 and 9D) between the intermediate position and the use position, a second stage of the multi-stage deployment mechanism is activated or engaged to further resist movement of the table assembly 100 toward the use position. For example, with the second stage activated, a second compression spring of the telescoping first biasing mechanism 142 is engaged to resist movement of the table assembly 100 from the cleaning position toward the use position. Due to the telescoping nature of the first biasing mechanism 142, the second stage is not engaged as the table assembly 100 is moved between the cleaning position and the intermediate position. The second stage of the multi-stage deployment mechanism may preclude the table assembly 100 from moving from the cleaning position until further manual input is provided by the user.

In other words, the second stage of the multi-stage deployment mechanism may at least temporarily stop or preclude movement of the table assembly 100 at the cleaning or safety position. This prevents the table assembly 100 from moving too quickly from the folded or intermediate positions to the use position, which could cause damage to the table assembly 100 or objects inadvertently left underneath the table assembly 100 or risk injury to a user whose hands or limbs are between the respective tabletop surfaces 102 or benches 104. Further, the cleaning position positions the table assembly 100 such that the tabletop surfaces 102 and benches 104 may be easily wiped down or cleared by the user.

In some examples, the legs 108 engage the ground surface 10 and the casters 110 are lifted off the ground surface 10 as the table assembly 100 is moved from the intermediate position to the cleaning position. This may provide further resistance to movement of the table assembly 100 from the cleaning position toward the use position.

When the table assembly 100 is moved from the cleaning position to the use position, such as by pushing further downward on the benches 104 or the tabletop surfaces 102*a*, 102*b*, the first portion 106*a* of the frame 106 and the second portion 106*b* of the frame 106 pivot relative to one another about the pivot axis $A_{106}$ of the hinge mechanism 114, with the first stage and the second stage of the deployment mechanism dampening movement of the table assembly toward the use position. That is, the outer ends of the table assembly 100 move even further away from one another along the ground surface 10, and the central portion of the table assembly 100 moves even further vertically downward until the tabletop surfaces 102*a*, 102*b* and the benches 104 are generally flat or horizontal and the legs 108 engage the ground surface 10 and the casters 110 are lifted from the ground surface 10.

The central biasing mechanism 144 enables a third stage of the multi-stage deployment mechanism that biases the table assembly 100 from the use position toward the intermediate position. That is, the third stage of the multi-stage deployment mechanism may be engaged or activated throughout the range of motion of the table assembly 100 from the use position to the intermediate position, and optionally to the folded position, to dampen movement of the table assembly 100 toward the use position and assist the user in folding the table assembly 100 to the folded position. For example, the telescoping central biasing mechanism 144 includes one or more compression springs that engage as the table assembly 100 is moved from the folded position toward the use position and the central biasing mechanism 144 is compressed.

Accordingly, each stage of the multi-stage deployment mechanism may bias the table assembly 100 from the use position toward the intermediate position. The first stage of the first biasing mechanism 142 may engage as the table assembly 100 moves from the folded position toward the intermediate position and the second end 142*b* engages the end of the slot 152 of the yoke 150. The first stage remains engaged as the table assembly 100 moves from the intermediate position toward the use position. Thus, the first stage is engaged as the table assembly 100 is moved between the use position and the intermediate position and the first stage is not engaged as the table assembly 100 is moved between the intermediate position and the folded position. The second stage of the first biasing mechanism 142 may engage as the table assembly 100 moves from the intermediate position toward the cleaning position and the telescoping housing of the biasing mechanism 142 compresses to engage the second stage. The second stage remains engaged as the table assembly 100 moves from the cleaning position toward the use position. Thus, the second stage is engaged as the table assembly 100 is moved between the use position and the cleaning position and the second stage is not engaged as the table assembly 100 is moved between the cleaning position and the folded position. The third stage of the second biasing mechanism 144 may be engaged as the table assembly 100 moves from the folded position or the intermediate position toward the use position based on compression of the telescoping housing of the second biasing mechanism 144.

The accumulative biasing force of the multi-stage deployment mechanism as the table assembly 100 moves toward the use position ensures a smooth and safe unfolding of the table assembly 100. Further, the multi-stage deployment mechanism biases the table assembly 100 toward the intermediate position and thus assists the user in folding the table assembly 100. It should be understood that the first biasing mechanism 142 and/or the second biasing mechanism 144 may each accommodate any number of biasing elements (e.g., compression springs), such as two or more or three or more biasing elements, that engage or activate at different compression limits of the telescoping housing to provide varying levels of dampening throughout the range of motion of the table assembly 100.

To prevent the table assembly 100 from folding or unfolding beyond a desired position, the locking bar 122 of the hinge mechanism 114 is movable into respective notches 120 at the first hinge plate 118*a* and the second hinge plate 118*b*. For example, with the table assembly 100 in the use position (FIG. 9A), the locking bar 122 may be moved into aligned notches 120 of the first hinge plate 118*a* and the second hinge plate 118*b* to prevent the biasing forces of the deployment mechanism from moving the table assembly 100 toward the intermediate position. Further, with the table assembly 100 in the cleaning position (FIG. 9D), the locking bar 122 may be moved into a notch 120 between the hinge plates 118*a*, 118*b* to prevent gravitational forces from moving the table assembly 100 to the use position.

Thus, in sum, the table assembly 100 may be movable from the use position, where the first portion 102*a* of the tabletop 102 and the second portion 102*b* of the tabletop 102 extend generally parallel to one another and the ground surface 10 (FIG. 9A) to the intermediate position. In the intermediate position, the first portion 106*a* of the frame 106 and the second portion 106*b* of the frame 106 are pivoted relative to one another about the pivot axis $A_{106}$ from the use position so that the first surface 102*a* of the tabletop 102 and the second surface 102*b* of the tabletop 102 extend at an oblique angle relative to the ground surface 10 (FIG. 9C). That is, the angle $\theta_{102a}$ between the first tabletop surface 102*a* and the ground surface 10 and the angle $\theta_{102b}$ between the second tabletop surface 102*b* and the ground surface 10 are non-right angles, such as an acute angle. The first portion 106*a* of the frame 106 and the second portion 106*b* of the frame 106 may be pivoted relative to one another about the pivot axis $A_{106}$ further from the use position beyond the intermediate position to the folded position (FIG. 9B), where the locking mechanism 154 may be engaged to secure the table assembly 100 in the folded position. Because at least the first biasing mechanisms 142 are not engaged between the intermediate position and the folded position, the user may have an easier time moving the table assembly 100 to the folded position. The angles $\theta_{102a}$, $\theta_{102b}$ may be greater at the folded position than the intermediate position. Further, the table assembly 100 may be movable to the tilted or cleaning position (FIG. 9D), where the first portion 106*a* of the frame 106 and the second portion 106*b* of the frame 106 are pivoted relative to one another about the pivot axis $A_{106}$ to a position between the use position and the intermediate position. The locking bar 122 may retain the table assembly 100 in the cleaning position, and this position may allow for a user to wipe down or otherwise clean the surfaces of the table assembly 100. The angles $\theta_{102a}$, 0102*b* may be smaller at the cleaning position than the intermediate position.

Figure 11:
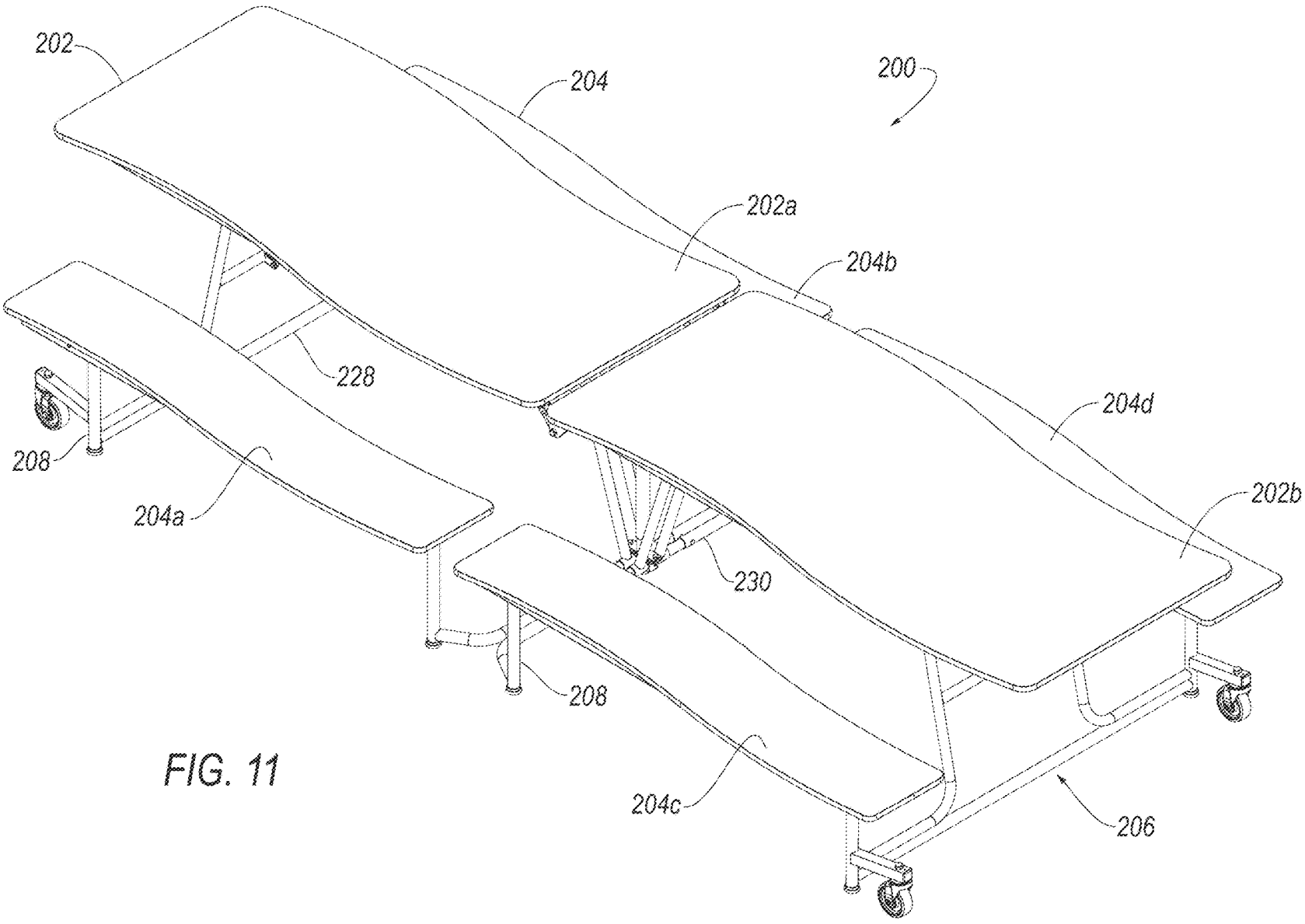
FIGS. 11 and 12 are views of another table assembly having wave-shaped tabletop surfaces and benches.
Figure 12:
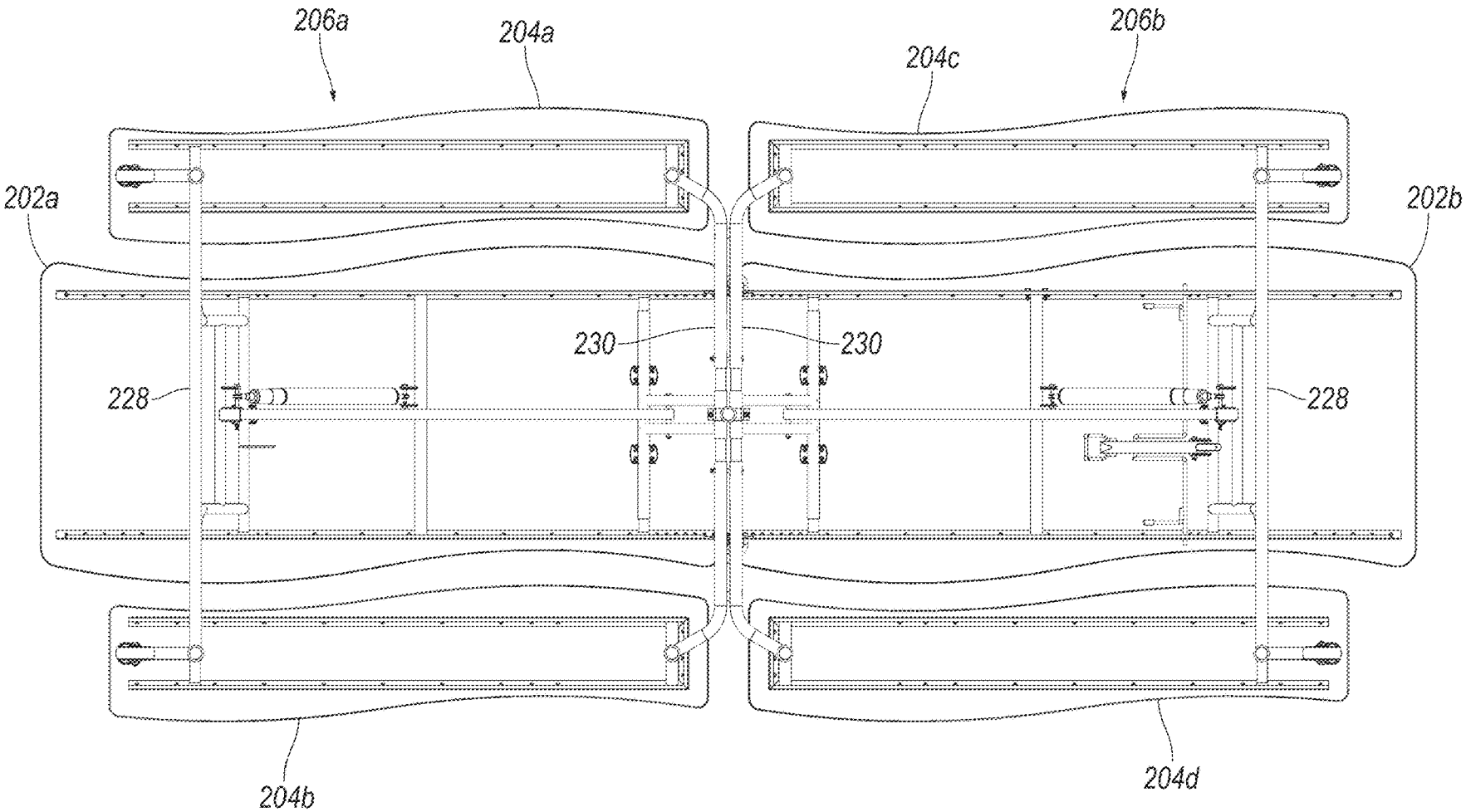

Although shown as having rectangular tabletops 102 and rectangular bench seats 104, it should be understood that the table assembly may include tabletops and bench seats having any suitable shape or contour. For example, and referring to FIGS. 11 and 12, a table assembly 200 includes a tabletop 202 and a bench seat 204 supported at a frame 206, where the tabletop 202 and the bench seat 204 both have a wave or sinusoidal shape. In other words, the tabletop 202 and the bench seat 204 have wavy or curved outer edges as compared to the straight or flat outer edges of the table assembly 100. As shown in FIG. 12, the wave-shape of a first surface 202*a* of the tabletop 202 supported at a first portion 206*a* of the frame 206 is parallel to the wave-shapes of a first bench 204*a* supported at the first portion 206*a* of the frame 206 along one side of the first surface 202*a* and a second bench 204*b* supported at the first portion 206*a* of the frame 206 along the opposing side of the first surface 202*a*. Similarly, the wave-shape of a second surface 202*b* of the tabletop 202 supported at a second portion 206*b* of the frame 206 is parallel to the wave-shapes of a third bench 204*c* supported at the second portion 206*b* of the frame 206 along one side of the second surface 202*b* and a fourth bench 204*d* supported at the second portion 206*b* of the frame 206 along the opposing side of the second surface 202*b*. Moreover, the tabletop 202 and the benches 204 may be configured such that the wave-shapes form a substantially continuous wave extending from one end of the table assembly 200 at the first portion 206*a* of the frame 206 to the opposing end of the table assembly 200 at the second portion 206*b* of the frame 206.

Outer stretchers 228 and inner stretchers 230 extending between respective legs 208 of the frame 206 may be longer than the frame 106 of the table assembly 100, resulting in a wider frame 206 to accommodate greater widths of the tabletop 202 and the bench seat 204. Otherwise, the table assembly 200 may have a multi-stage deployment mechanism and locking mechanism substantially similar to the table assembly 100.

Further, although shown as having bench-style seating, some examples of the table assembly may include stool-style seating with the deployment mechanism and pivoting features of the table assembly accommodating pivoting of the stool seats relative to the tabletops during folding and unfolding of the table assembly. For example, and in reference to FIGS. 13-23, a table assembly 300 having a multi-stage deployment mechanism and locking mechanism includes stool-style seats supported at its frame. That is, the table assembly 300 includes a tabletop 302 and a seat 304 supported at a frame 306, where the seat 304 includes a plurality of stools 304*a*-*m* each configured to support a user sitting at the table assembly 300. In the illustrated example, a first portion 306*a* of the frame 306 supports a first portion or surface 302*a* of the tabletop 302, with stools 304*a*, 304*b*, 304*c* along one side of the first surface 302*a* and stools 304*d*, 304*e*, 304*f* along the other side of the first surface 302*a*. Similarly, a second portion 306*b* of the frame 306 supports a second portion or surface 302*b* of the tabletop 302, with stools 304*g*, 304*h*, 304*i* along one side of the second surface 302*b* and stools 304*j*, 304*k*, 304*m* along the other side of the second surface 302*b*. The table assembly 300 may include any number of stools 304, such as four stools, six stools, eight stools, or more.

As discussed further below, the frame 306 is foldable to adjust the table assembly 300 between a use position (FIG. 13), where the frame 306 is extended and the tabletop 302 and stools 304 are positioned for use by one or more users, and a non-use or folded position (FIG. 16), where the frame 306 is folded for compact storage of the table assembly 300. The frame 306 is configured so that a respective leg 308 extends beneath each stool 304 to support the table assembly 300 at the ground surface 10 in the use position. Lockable casters or wheels 310 are disposed at the outermost legs 308 at outer ends of the table assembly 300 to support the table assembly 300 and enable movement of the table assembly 300 along the ground surface 10 in the folded position. Non-slip or rubber feet 312 may be disposed at ends of the legs 308 between the outer ends of the table assembly 300 to engage the ground surface 10 and prevent movement of the table assembly 300 in the use position.

The table assembly 300 is equipped with a multi-stage deployment mechanism configured to dampen movement of the table assembly 300 from the folded position to the use position and to assist the user in folding the table assembly 300 from the use position toward the folded position. Moreover, the table assembly 300 is equipped with a locking mechanism 354 (FIGS. 17A and 17B) for securing the table assembly 300 in the folded position. Similar to the table assembly 100, the multi-stage deployment mechanism of the table assembly 300 enables controlled movement of the table assembly 300 between at least the folded position, the use position, an intermediate position, and a cleaning position with reduced risk of injury or damage during deployment of the table assembly 300 and without requiring excessive force to deploy or fold the table assembly 300.

A hinge mechanism 314 pivotally connects the first portion 306*a* and the second portion 306*b* of the frame 306 at a central portion of the table assembly 300. For example, a first hinge plate 318*a* mounted to the first frame portion 306*a* is pivotally attached to a second hinge plate 318*b* mounted to the second frame portion 306*b* to define a pivot axis $A_{306}$ between the first portion 306*a* and the second portion 306*b* of the frame 306. The first hinge plate 318*a* and the second hinge plate 318*b* include respective notches 320 configured to receive a pin or locking bar 322 to preclude pivoting of the frame 306 about the pivot axis $A_{306}$ and lock the table assembly 300 in one or more positions of the table assembly 300.

Figure 14:
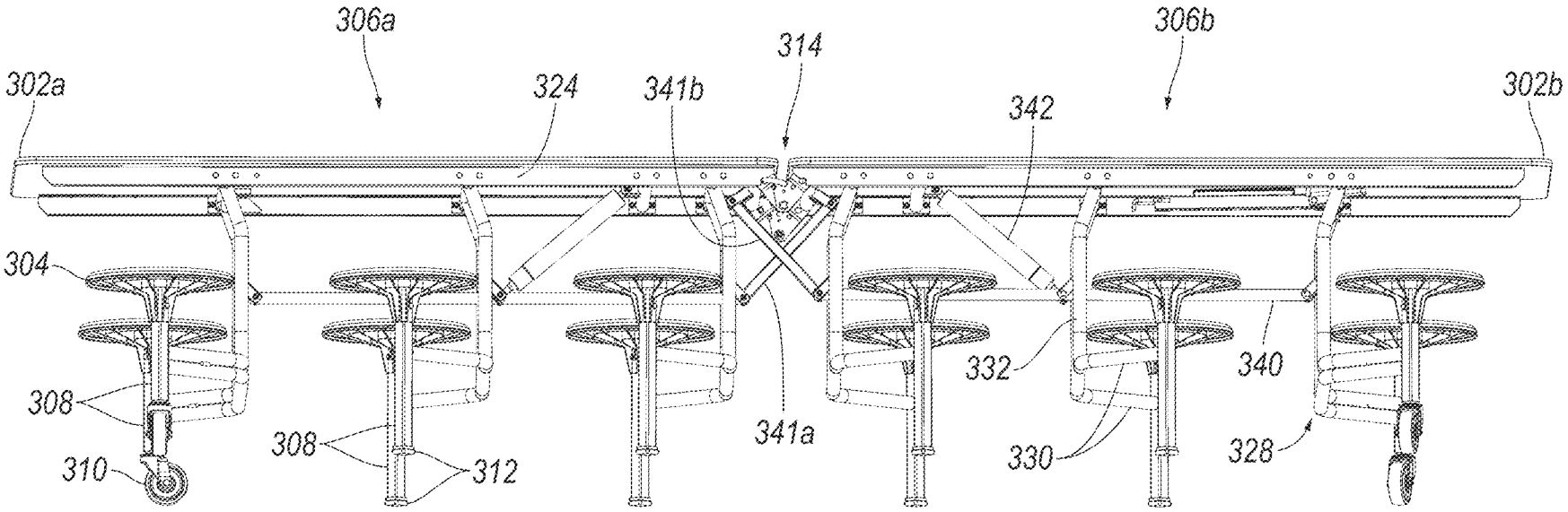
Figure 15:
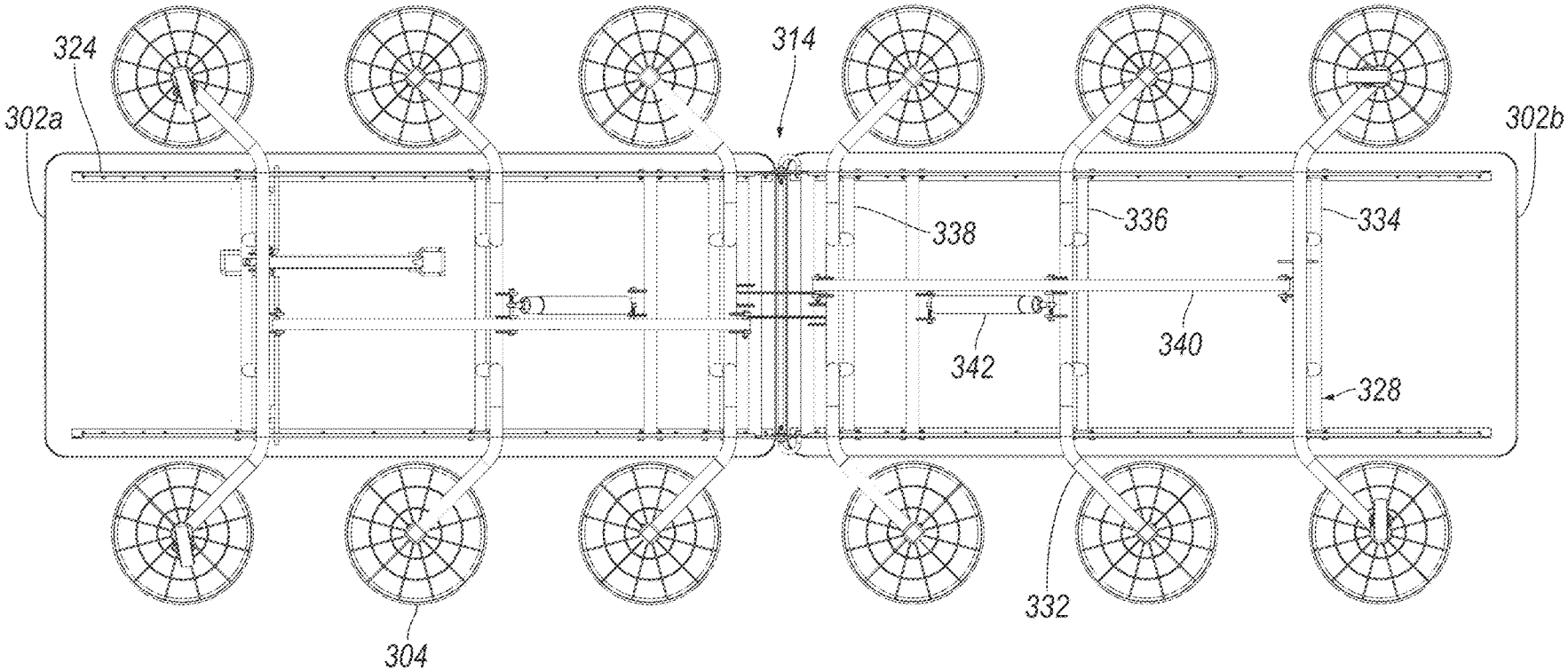

Referring to FIGS. 14 and 15, each portion 306*a*, 306*b* of the frame 306 includes an apron formed from a set of rails 324 extending parallel to one another and mounted to a lower surface along opposing sides of the tabletop portions 302*a*, 302*b*. The rails 324 at the first tabletop surface 302*a* are pivotally attached to the rails 324 at the second tabletop surface 302*b* via the hinge mechanism 314.

Pairs of stools 304 along opposing sides of the tabletop 302 from one another are pivotally attached to the rails 324 via respective stretcher assemblies 328 of the frame 306. For example, the stools 304 at the outer ends of the table assembly 300 (i.e., the stools 304*a*, 304*d* at one end of the table assembly 300 and the stools 304*i*, 304*m* at the other end of the table assembly 300) are connected to one another by respective stretcher assemblies 328. Each subsequent pair of stools 304 between the ends of the table assembly 300 are similarly connected to one another by a respective stretcher assembly 328, and each stretcher assembly 328 is in turn pivotally attached between the rails 324.

As shown, each stretcher assembly 328 includes a brace portion 330 extending from the leg 308 at the respective stool 304 inward toward the tabletop 302 to a strut or upright portion 332. With the table assembly 300 in the use position, the brace portions 330 may extend at or near the ground surface 10 to limit interference with the user entering and exiting the stool 304. The upright portions 332 of each stretcher assembly 328 extend upward from the brace portion 330 and pivotally attach between the rails 324 via a respective cross-rail. For example, the stretcher assemblies 328 pivotally attaching at the outermost ends of the table assembly 300 are coupled to outer cross-rails 334. The stretcher assemblies 328 pivotally attaching at the central portion of the table assembly 300 are coupled to inner cross-rails 338, and the stretcher assemblies 328 pivotally attaching between the central portion and the outer ends of the table assembly 300 are coupled to intermediate cross-rails 336. The cross-rails 334, 336, 338 may be received in respective caps at the rails 324 to enable pivoting of the cross-rails 334, 336, 338 relative to the frame 306.

Respective linking braces 340 extend between the stretcher assemblies 328 at each portion 306*a*, 306*b* of the frame 306 so that the stools 304 of each portion 306*a*, 306*b* pivot together and in tandem as the table assembly 300 is moved between the use position and the folded position. For example, the linking braces 340 are pivotally attached to yokes of each respective stretcher assembly 328. Further, a first pivot or scissor linkage 341*a* extends between the inner most stretcher assembly 328 of the first frame portion 306*a* and a yoke at the second frame portion 306*b* and a second pivot or scissor linkage 341*b* extends between the inner most stretcher assembly 328 of the second frame portion 306*b* and a yoke at the first frame portion 306*a*. The respective scissor linkages 341*a*, 341*b* ensure that the first portion 306*a* and the second portion 306*b* of the frame 306 pivot together as the table assembly 300 is moved between the use position and the folded position.

Thus, as the table assembly 300 is moved between the use position and the folded position, the respective stretcher assemblies 328 at each side of the table assembly 300 pivot together and in tandem with one another and remain substantially parallel to one another. For example, the tandem rotation of the stretcher assemblies 328 relative to the rails 324 may maintain the legs 308 in generally vertical orientations relative to one another and the ground surface 10 throughout the range of motion of the table assembly 300 (e.g., within about 5 degrees or less or 10 degrees or less of vertical). This prevents interference between respective stools 304 during folding and unfolding of the table assembly 300 and allows for the use of differently configured stools 304 at the same table assembly 300, as discussed further below.

Figure 13:
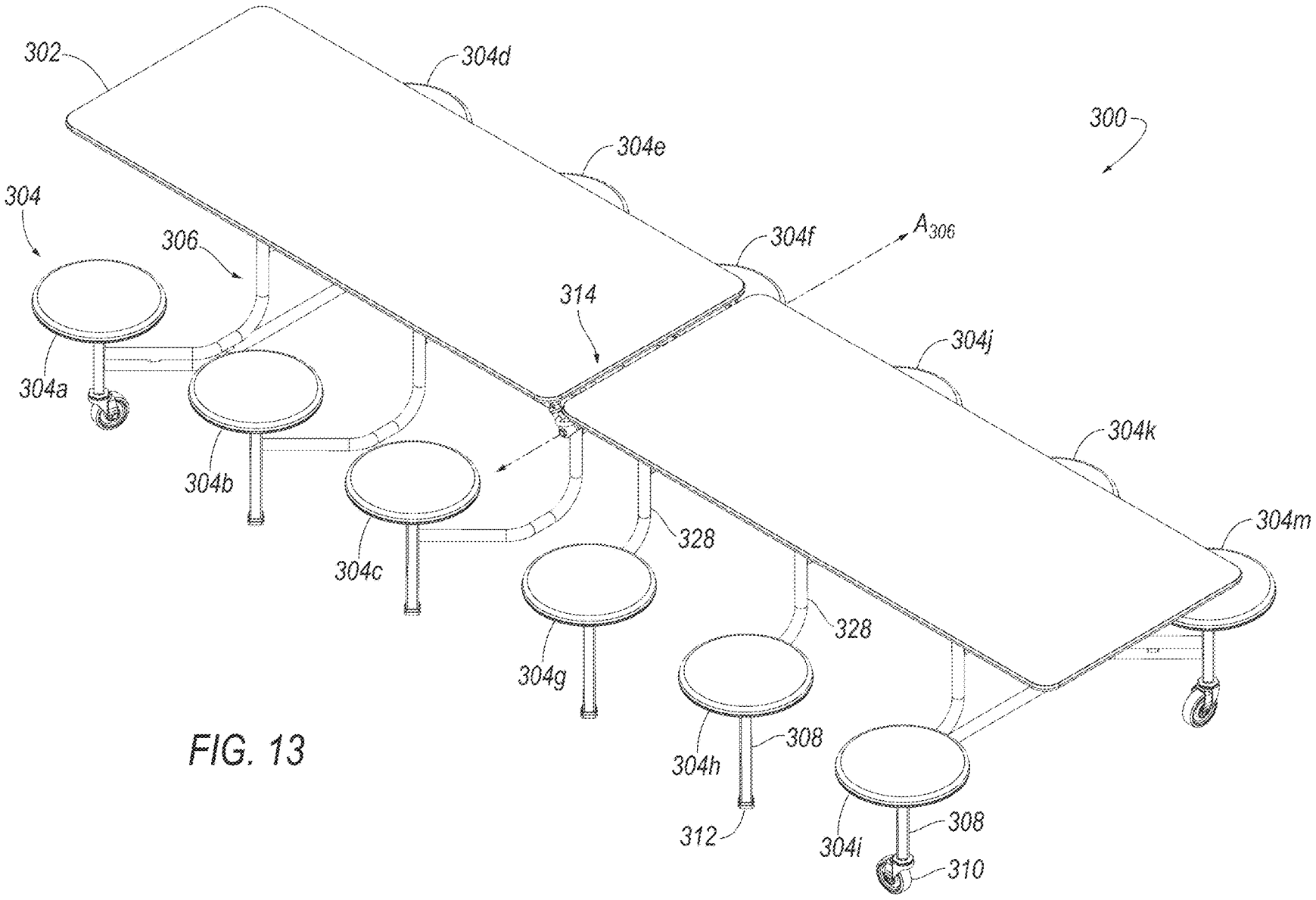
FIGS. 13-15 are views of another table assembly having stool seats and in an unfolded or use position.

As shown in FIGS. 13 and 14, with the table assembly 300 in the use position, the first surface 302*a* of the tabletop 302 and the second surface 302*b* of the tabletop 302 extend generally parallel to one another in a flat or horizontal position. Seating surfaces of the stools 304 likewise extend generally parallel to one another and the tabletop in flat or horizontal positions, with the stools 304 spaced from one another along the sides of the table assembly 300, so that users may sit at the stools 304 while using the tabletop surfaces 302*a*, 302*b*. The legs 308 and the casters 310 support the table assembly 300 in the use position with the feet 312 engaging the ground surface 10 and the casters 310 locked to preclude movement of the table assembly 300 along the ground surface 10.

Figure 16:
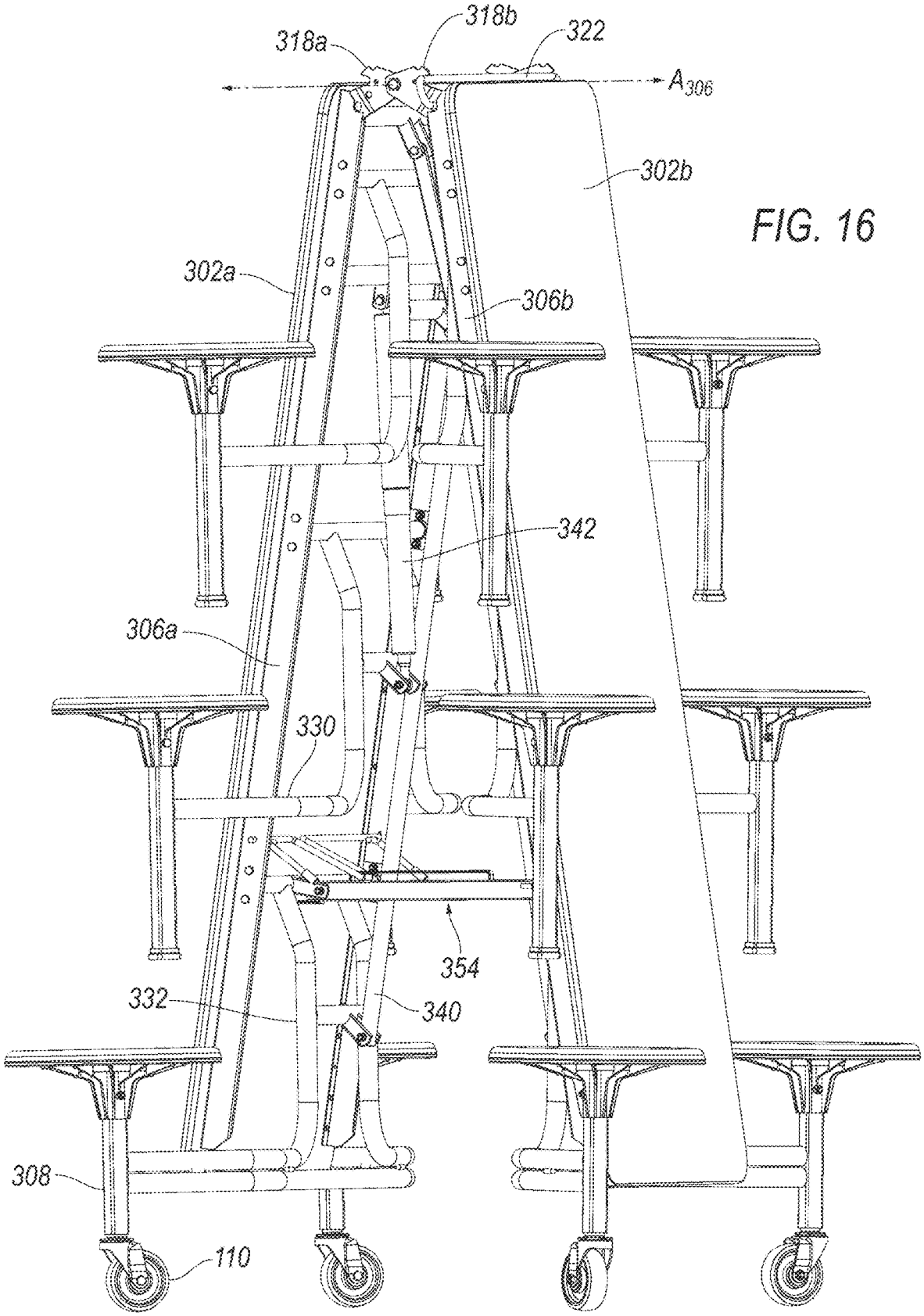
FIG. 16 is a perspective view of the table assembly of FIGS. 13-15 in a folded position.
Figure 17A:
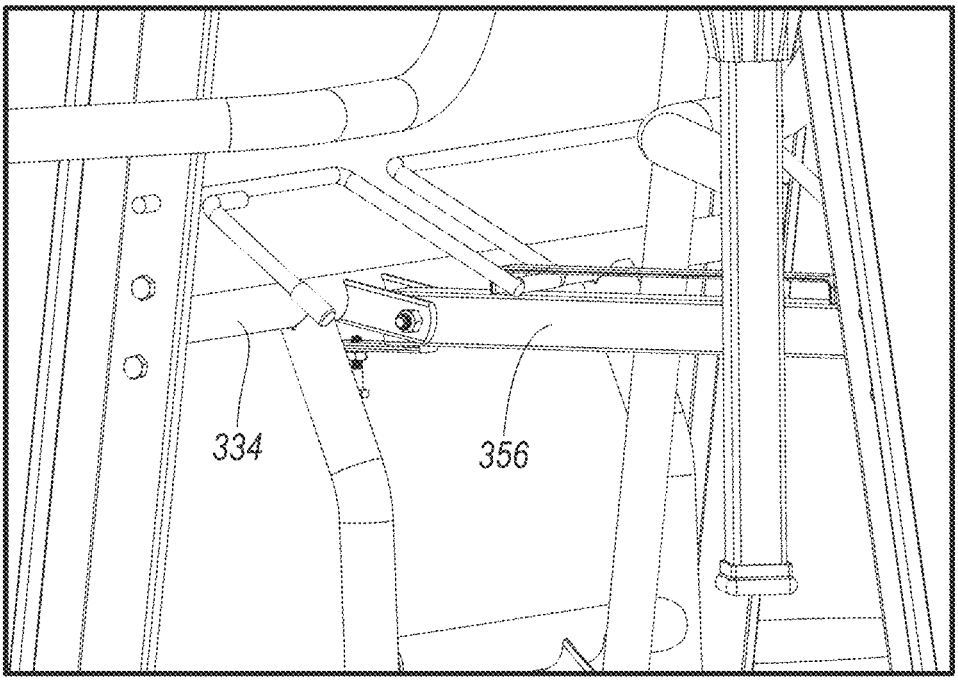
FIGS. 17A and 17B are partial views of the table assembly of FIGS. 13-15 in the folded position, showing a locking mechanism of the table assembly securing the table assembly in the folded position.
Figure 17B:
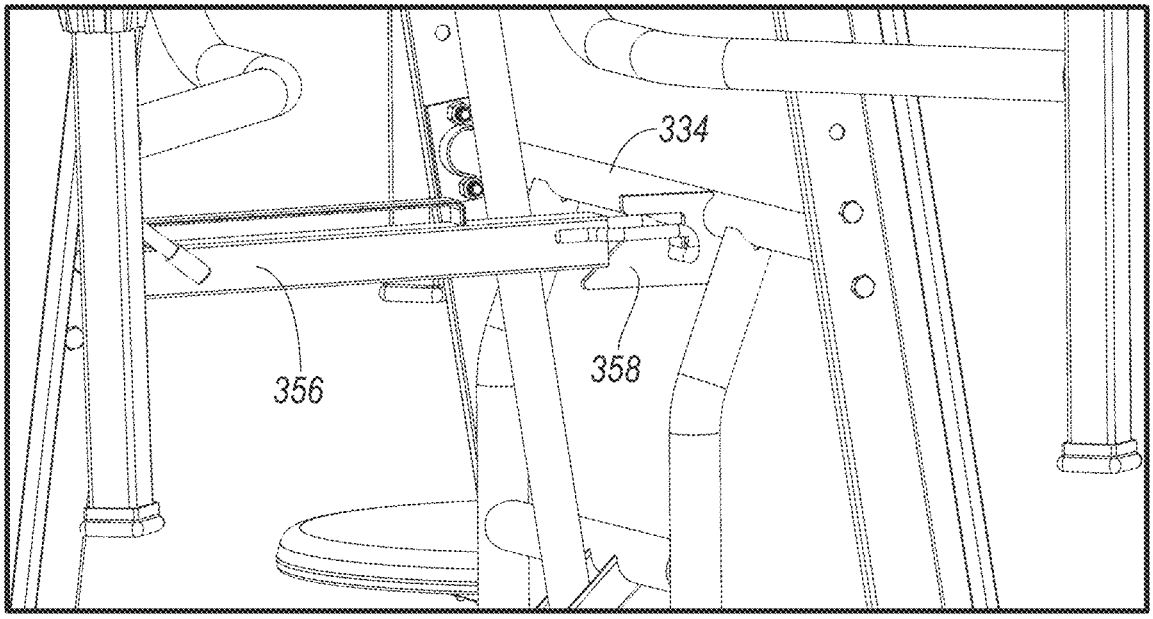

In reference to FIGS. 16, 17A, and 17B, when the table assembly 300 is moved to the folded position, the first portion 306*a* of the frame 306 and the first surface 302*a* of the tabletop 302 are pivoted relative to the second portion 306*b* of the frame 306 and the second surface 302*b* of the tabletop 302 about the pivot axis $A_{306}$ to position the first surface 302*a* and the second surface 302*b* in generally upright or vertical positions relative to the ground surface 10 and to substantially fold or collapse the frame 306 between the portions of the tabletop 302. The stretchers 328 move the stools 304 according to movement of the frame 306 and the tabletop 302.

As the table assembly 300 moves toward the folded position, legs 308 at the central portion of the table assembly 300 are lifted off the ground surface 10 as the inner ends of the table surfaces 302*a*, 302*b* move vertically upward and the stretchers 328 fold or pivot toward the tabletop 302. As shown in FIG. 16, the brace portions 330 are angled relative to the upright portions 332 of the stretcher assemblies 328 to maintain the stools 304 and legs 308 in substantially upright or vertical positions throughout the range of motion of the table assembly 300. This maximizes space between the stools 304 during movement of the table assembly 300 between positions and thus permits the table assembly 300 to accommodate larger stools 304, such as stools 304 having a width or diameter of 15 inches or more. Further, this allows the casters 310 to remain engaged with the ground surface 10 throughout movement of the table assembly 300 between the use position and the folded position. Thus, the legs 308 at the outer ends of the table assembly 300 move along the ground surface 10 as the outer ends of the table assembly 300 move toward one another (e.g., via the casters 310 moving along the ground surface 10).

The table assembly 300 includes a multi-stage deployment mechanism that biases the table assembly 300 toward the folded position to assist the user in folding the table assembly 300 from the use position and dampen or resist unfolding of the table assembly 300 toward the use position. In the illustrated example of FIGS. 13-23, the multi-stage deployment mechanism includes a cylinder or biasing mechanism 342 at each of the first portion 306*a* of the frame 306 and the second portion 306*b* of the frame 306. The biasing mechanism 342 enables or activates various stages of the deployment mechanism as the table assembly 300 moves between the use position and the folded position to provide varying biasing forces throughout movement of the table assembly 300. For example, the biasing mechanisms 342 may include gas cylinders or torque bars or compression springs accommodated within telescoping cylindrical housings.

Figure 18B:
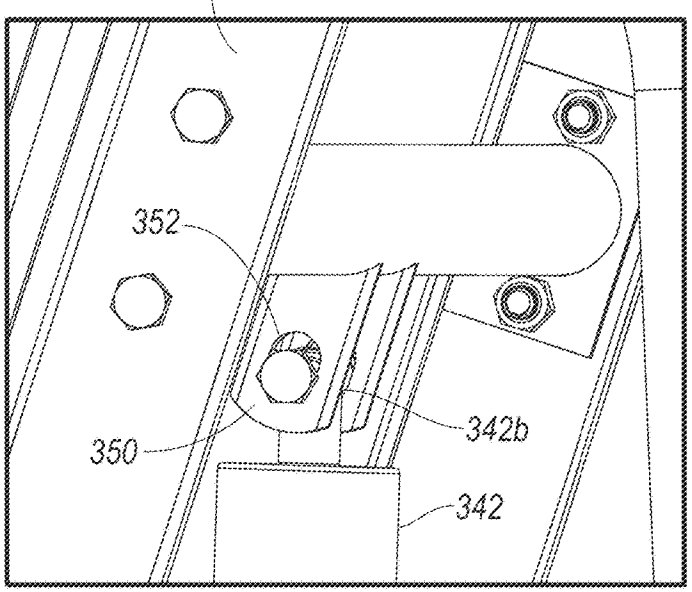
FIG. 18B is an enlarged view of area 18B in FIG. 18A.
Figure 18A:
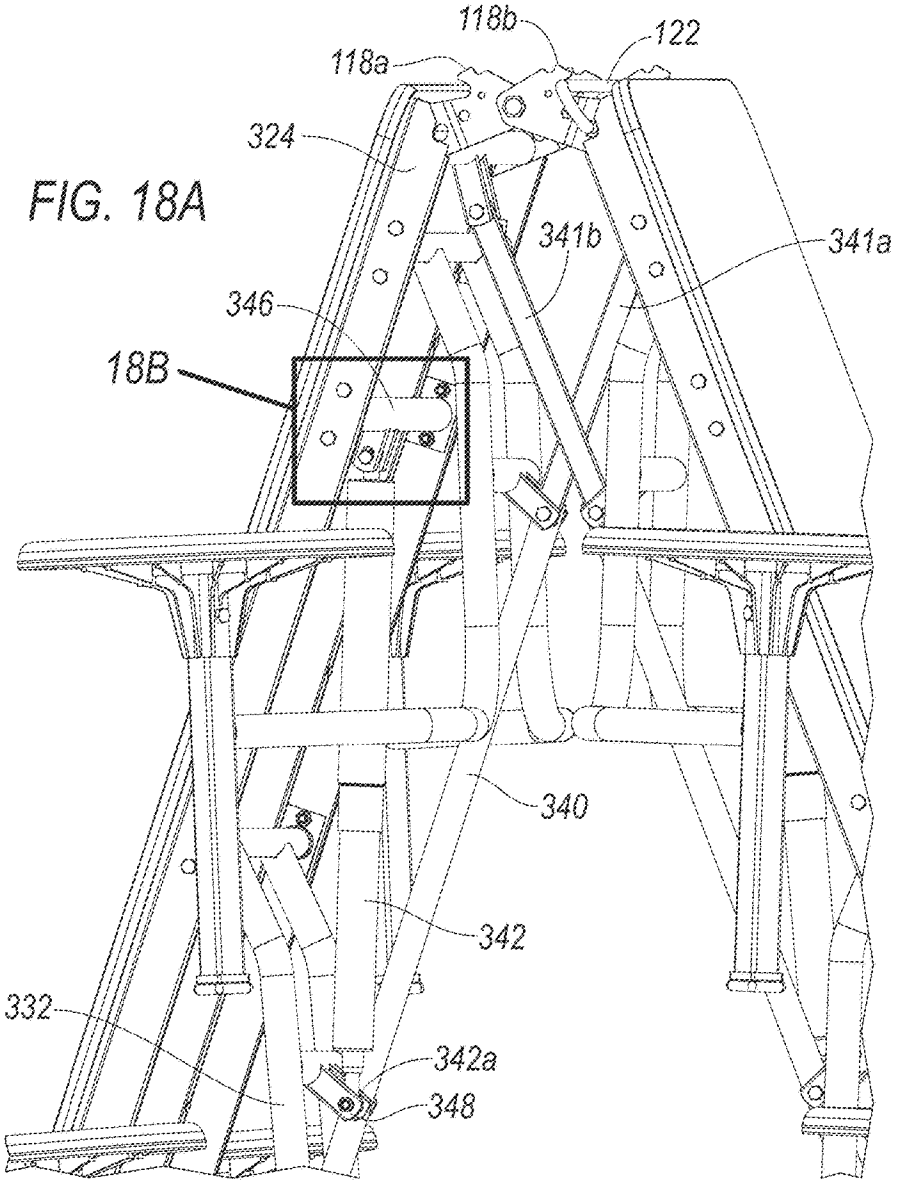
FIG. 18A is a partial view of the table assembly of FIGS. 13-15.
Figure 19:
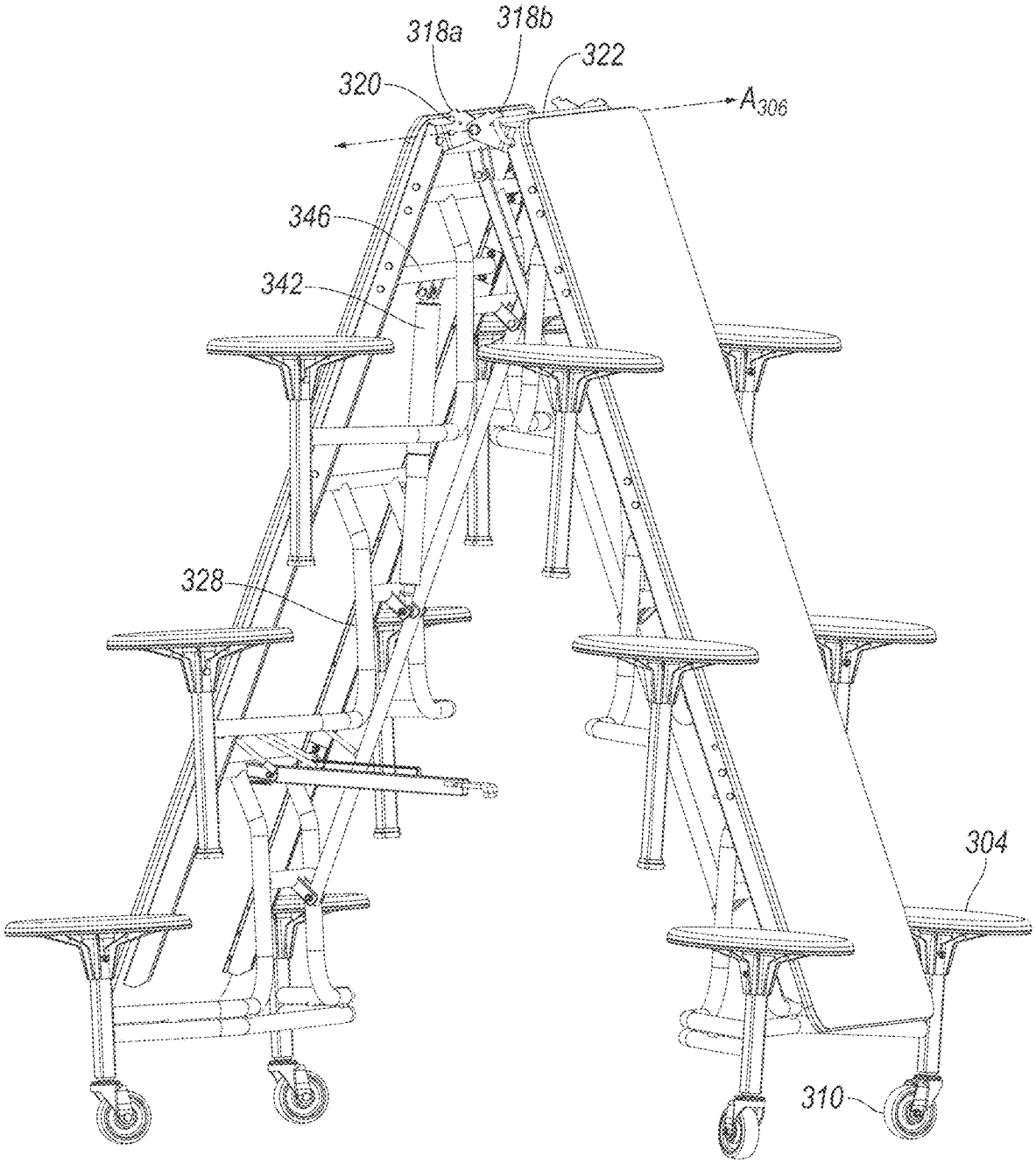
FIG. 19 is a perspective view of the table assembly of FIGS. 13-15 in an intermediate position with the locking mechanism released.
Figure 20:
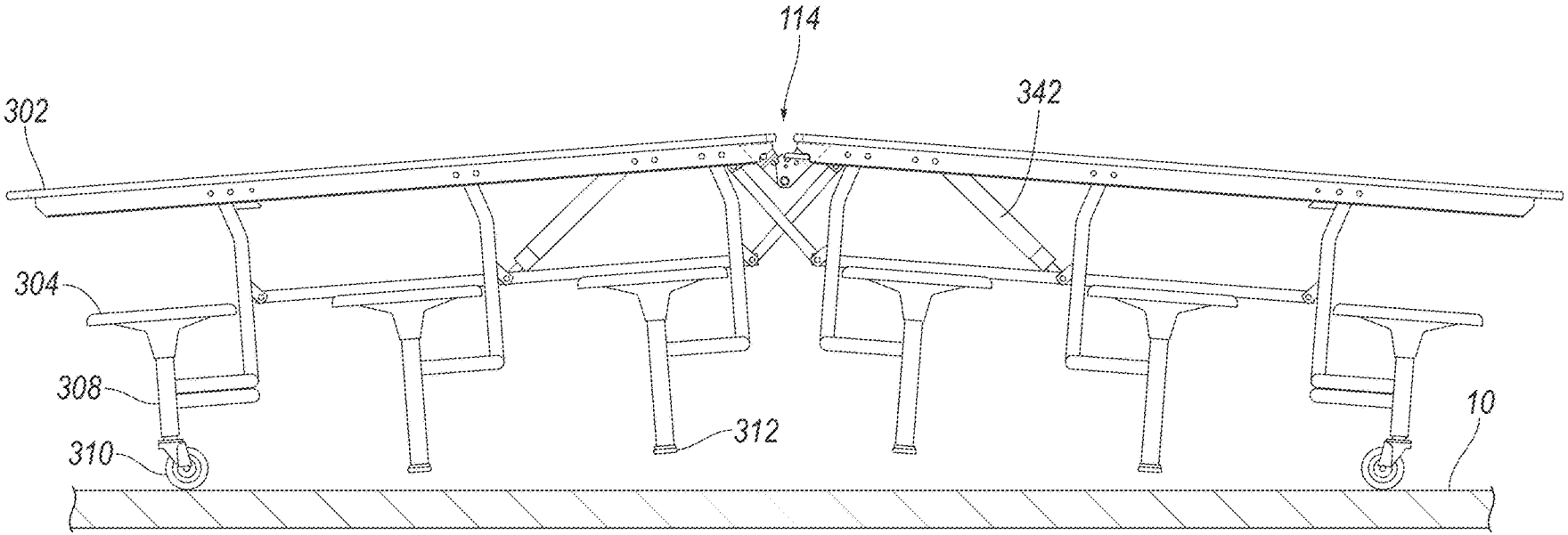
FIG. 20 is an environmental view of the table assembly of FIGS. 13-15 in a tilted or cleaning position.
Figure 21:
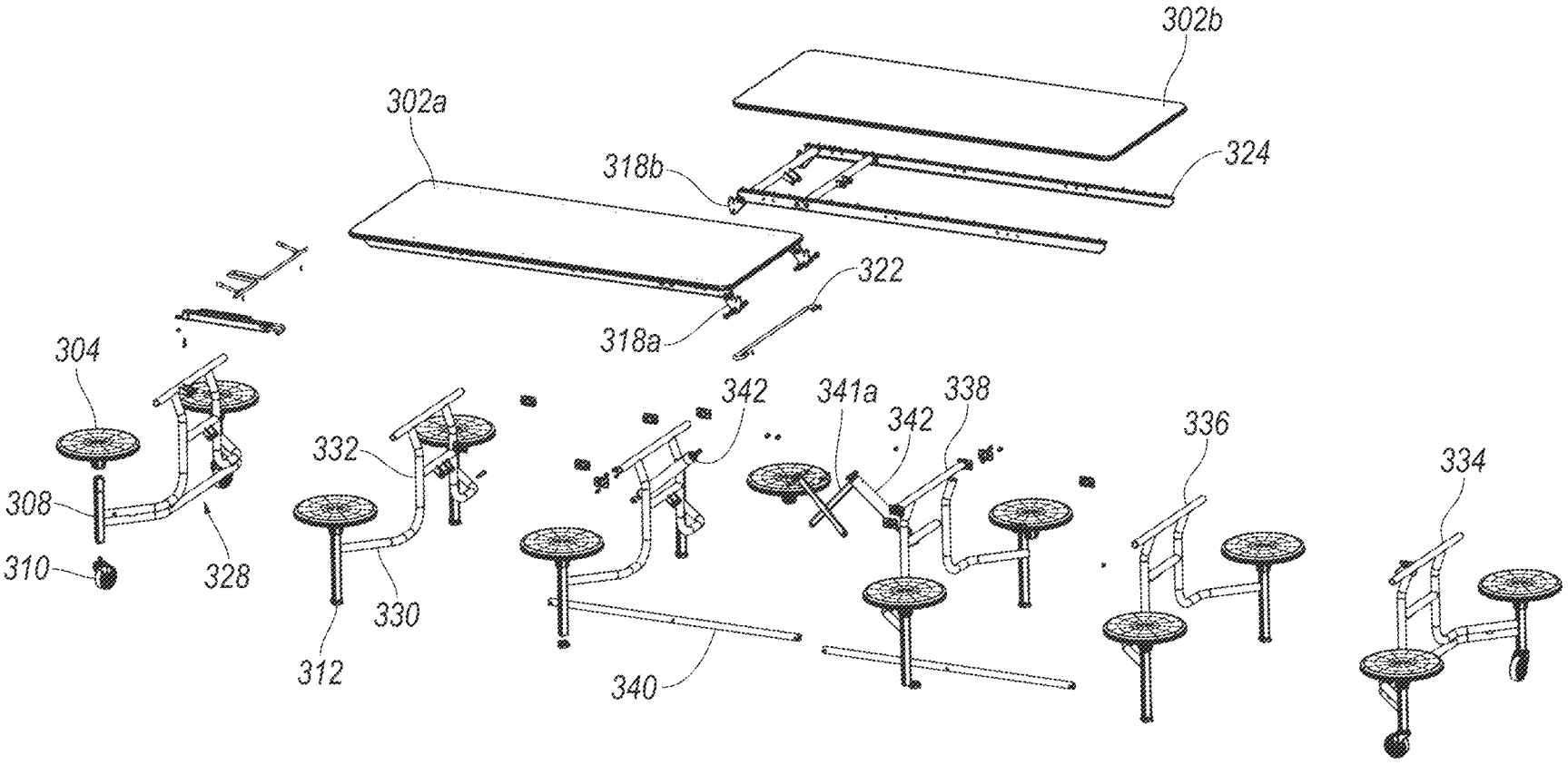
FIG. 21 is an exploded view of the table assembly of FIGS. 13-15.
Figure 22:
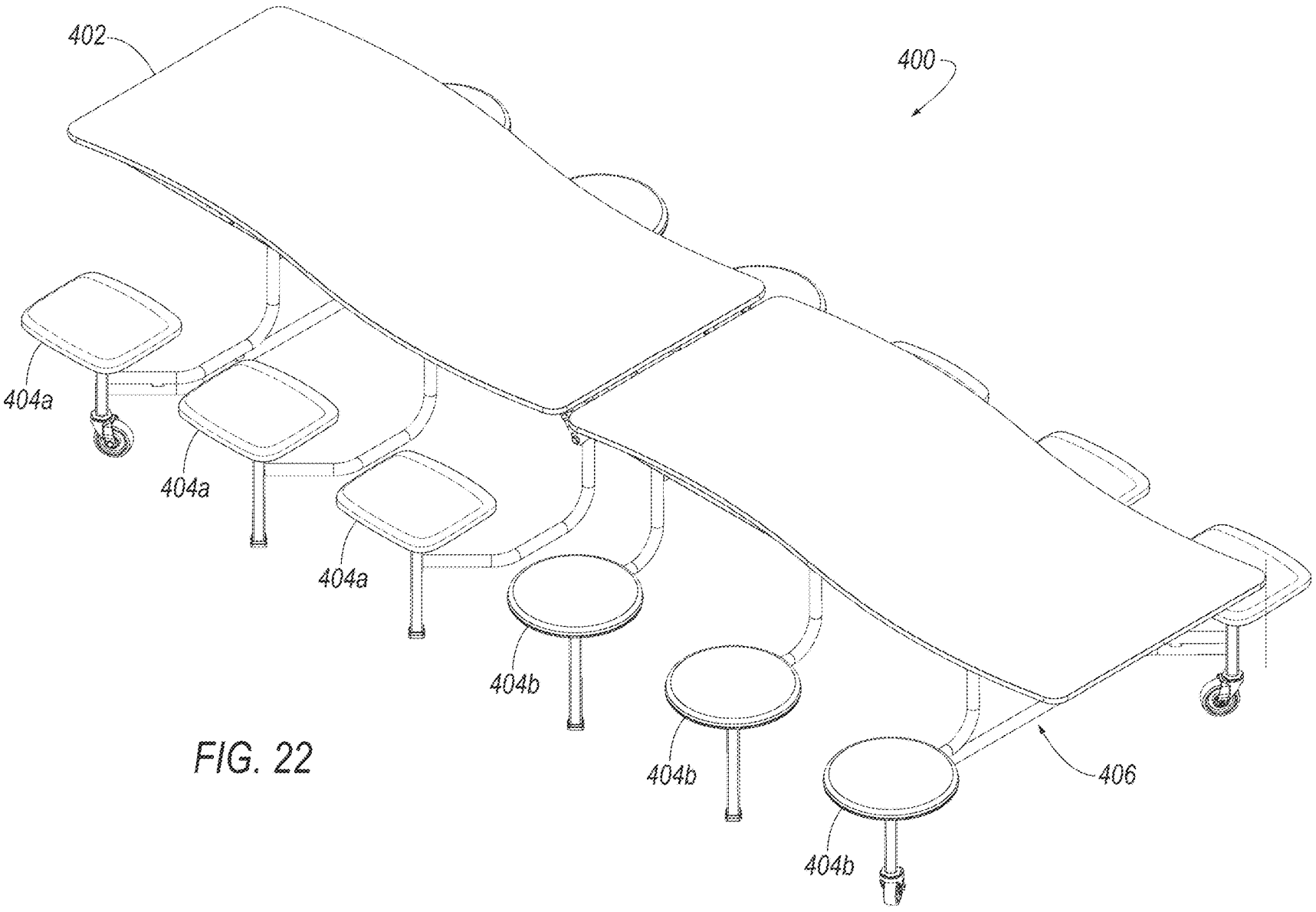
FIGS. 22 and 23 are views of another table assembly having stool seats and a wave-shaped tabletop surface.

As shown in FIGS. 18A and 18B, each biasing mechanism 342 extends between the upright portion 332 of a stretcher assembly 328 (e.g., the middle stretcher assembly 328 between the outermost stretcher assembly and the innermost stretcher assembly) and a fixed cross-member or cylinder adapter 346 extending between the rails 324, with the biasing mechanism 342 attaching between a yoke 348 of the upright 332 and a yoke 350 of the cylinder adapter 346. The cylinder adapter 346 may be bolted on or otherwise non-rotatably attached to the rails 324. Moreover, a mounting position of the cylinder adapter 346 along the rails 324 may be adjusted, such as based on a length of the tabletop 302, a length of the biasing mechanism 342, a height of the table assembly 300, a desired biasing power of the biasing mechanism 342 and the like. A first end 342*a* of the biasing mechanism 342 pivotally attaches at the upright portion 332 of the stretcher assembly 328 and a second end 342*b* opposite the first end 342*a* pivotally and slidably attaches at the yoke 350 of the cylinder adapter 346. For example, a pin or bolt extends through the first end 342*a* of the biasing mechanism 342 and the yoke 348 at the upright portion 332 to pivotally attach the first end 342*a* to the stretcher assembly 328. The second end 342*b* of the biasing mechanism 342 is slidably and pivotably attached at the yoke 350 at the cylinder adapter 346, such as via a pin extending through the second end 342*b* and a slot 352 of the yoke 350. Thus, the pin and the second end 342*b* of the biasing mechanism 342 may slide along the slot 352 and allow pivoting of the second end 342*b* relative to the cylinder adapter 346.

Thus, with the table assembly 300 in the folded position, the second end 342*b* of the biasing mechanism 342 may be at or near one end of the slot 352 and disengaged from the frame 306, that is not applying a biasing force at the frame 306 (FIGS. 18A and 18B). As the table assembly 300 moves from the folded position, the second end 342*b* moves along the slot 352 and engages the other end of the slot 352 to activate the biasing mechanism 342 and transfer biasing force to the frame 306. The biasing mechanism 342 at each portion 306*a*, 306*b* of the frame 306 expands as the table assembly 300 moves from the use position toward the folded position to urge the table assembly 300 toward the folded position, with the first end 342*a* pivoting relative to the yoke 348 at the stretcher assembly 328 and with the second end 342*b* pivoting and/or sliding relative to the yoke 350 at the cylinder adapter 346 to accommodate movement of the table assembly 300.

Similar to the table assembly 100, the table assembly 300 includes a locking mechanism 354 that engages to retain the table assembly 300 in the folded position (FIGS. 17A and 17B). For example, the striker bar 356 of the locking mechanism 354 may extend from the outer cross-rail 334 at the first portion 306*a* of the frame 306 and the keeper 358 may be disposed at the outer cross-rail 334 at the second portion 306*b* of the frame 306. The striker bar 356 and the keeper 358 may be configured to allow for pivoting of the respective outer cross-rails 334 relative to the striker bar 356 and keeper 358.

When the locking mechanism 354 is disengaged to allow the table assembly 300 to move from the folded position (FIG. 16) to the intermediate position (FIG. 19), the first portion 306*a* and the second portion 306*b* of the frame 306 pivot slightly away from one another about the pivot axis $A_{306}$ as the second ends 342*b* of the biasing mechanism 342 move along the slots 352 and engage or activate a first stage of the multi-stage deployment mechanism. That is, with the table assembly 300 in the intermediate position, the second ends 342*b* of the biasing mechanisms 342 engage the ends of the slots 352 to activate a first compression spring of the biasing mechanism 342. The first stage of the deployment mechanism resists movement of the table assembly 300 from the intermediate position toward the use position. Further, the first stage of the multi-stage deployment mechanism may retain the table assembly 300 in the intermediate position until further manual input is provided by the user.

When the user manually moves the table assembly 300 from the intermediate position toward the use position (FIGS. 13 and 14), such as by pushing downward on the stools 304 or the tabletop surfaces 302*a*, 302*b*, the first portion 306*a* and the second portion 306*b* of the frame 306 pivot relative to one another about the pivot axis $A_{306}$ of the hinge mechanism 314 with the first stage of the of the deployment mechanism dampening movement of the table assembly 300 toward the use position. As the table assembly 300 approaches the tilted or cleaning or safety position (FIG. 20) between the intermediate position and the use position, a second stage of the multi-stage deployment mechanism is activated or engaged to further resist movement of the table assembly 300 and/or stop movement of the table assembly 300 toward the use position. For example, with the second stage activated, a second compression spring of the telescoping biasing mechanism 342 is engaged to resist movement of the table assembly 300 from the cleaning position toward the use position. Due to the telescoping housing of the biasing mechanism 342, the second stage is not engaged as the table assembly 300 is moved between the cleaning position and the intermediate position. The second stage of the multi-stage deployment mechanism may preclude the table assembly 300 from moving from the cleaning position until further manual input is provided by the user, or the locking bar 322 may engage the notches 320 of the hinge plates 318*a*, 318*b* to retain the table assembly 300 at the cleaning position.

When the table assembly 300 is moved from the cleaning position to the use position, such as by pushing further downward on the stools 304 or the tabletop surfaces 302*a*, 302*b*, the first portion 306*a* of the frame 306 and the second portion 306*b* of the frame 306 pivot relative to one another about the pivot axis $A_{306}$ of the hinge mechanism 314, with the first stage and the second stage of the deployment mechanism dampening movement of the table assembly 300 toward the use position. The locking bar 322 may be engaged with the notches 320 of the hinge plates 318*a*, 318*b* of the hinge mechanism 314 to retain the table assembly 300 in the use position.

Thus, the table assembly 300 includes the biasing mechanism 342 that enables the first stage and the second stage of the multi-stage deployment mechanism. Optionally, the telescoping cylinder of the biasing mechanism 342 may accommodate any number of compression elements that engage or activate at any suitable pivotal position of the table assembly 300 to enable any number of dampening stages of the deployment mechanism. For example, the biasing mechanism 342 may accommodate four our more compression springs to provide accumulative dampening throughout the range of motion of the table assembly 300.

Figure 23:
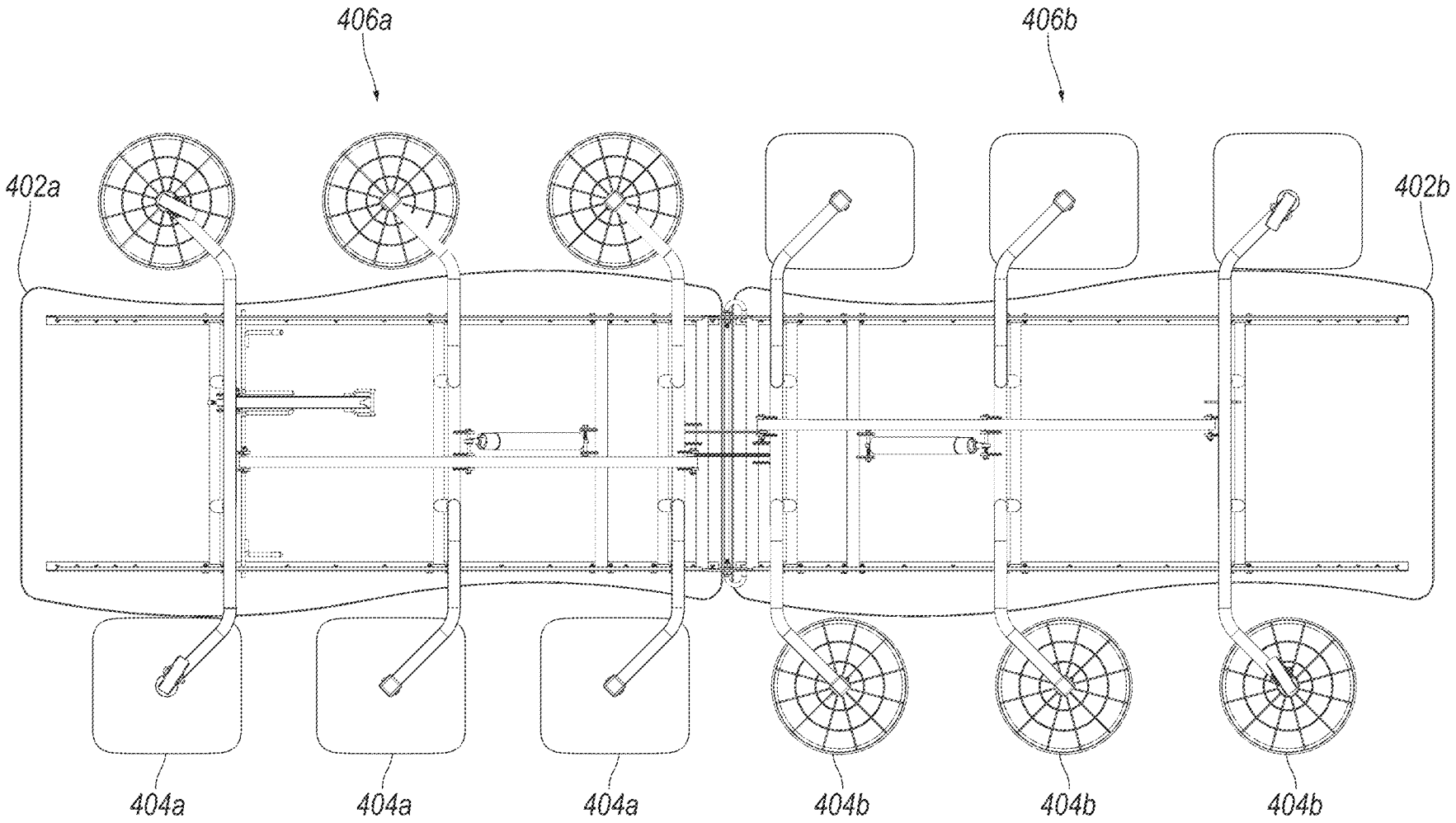

Although shown as having rectangular tabletops 302 implemented with round stool seats 304, it should be understood that the table assembly may include tabletops and bench seats having any suitable shape or contour. For example, and referring to FIGS. 22 and 23, a table assembly 400 includes a tabletop 402 having a wave or sinusoidal shape. In other words, the tabletop 402 has wavy or curved outer edges. As shown in FIG. 23, the tabletop 402 may be configured such that the wave-shapes of a first portion or surface 402*a* and a second portion or surface 402*b* of the tabletop 402 form a substantially continuous wave extending from one end of the table assembly 400 at a first portion 406*a* of the frame 406 to the opposing end of the table assembly 400 at a second portion 406*b* of the frame 406. In the illustrated example, the wave shape of the tabletop 402 curves in a generally sinusoidal pattern (e.g., left to right in FIG. 22), and the wave shape may curve in a cosine pattern or any suitable curved or non-linear form. The table assembly may utilize characteristics of the table assemblies described in U.S. Pat. Nos. RE49,984; RE48,884; and/or D1,020,340, which are hereby incorporated herein by reference in their entireties.

Moreover, the table assembly 400 includes stools 404 having both square or rectangular seating surfaces 404*a* and circular or rounded seating surfaces 404*b*. Although shown as having square seating surfaces 404*a* at one side of each tabletop surface 402*a*, 402*b* paired with circular seating surfaces 404*b* at the other side of the tabletop surfaces 402*a*, 402*b*, it should be understood that any desirable pattern of stools 404 may be implemented. Moreover, the stools 404 may be removable from the legs 408 and swappable with one another to create the desired pattern of stools 404. For example, each leg 408 may include a square or rectangular receiver or passageway configured to receive a corresponding post extending from the stool 404. The square or rectangular receiver and corresponding post of the stool 404 allow for quicker and easier alignment of the stool 404 at the leg 408 during installation, resulting in quicker assembly of the table 400 and substitution of differently configured stools 404. The table assembly 400 and stools 404 may utilize characteristics of the table assemblies and stools described in U.S. Pat. Nos. 7,758,113; 10,531,741; D1,000,182; D946,335; D893,932; D856,727; and/or D802,945, which are hereby incorporated herein by reference in their entireties.

Because the legs 408 of the frame 406 and the stools 404 maintain a substantially parallel or upright or vertical position throughout movement of the table assembly 400, the differently shaped stools 404 do not interfere with one another during movement of the table assembly 400. The table assembly 400 may have a multi-stage deployment mechanism and locking mechanism substantially similar to the table assemblies described herein.

Figure 24:
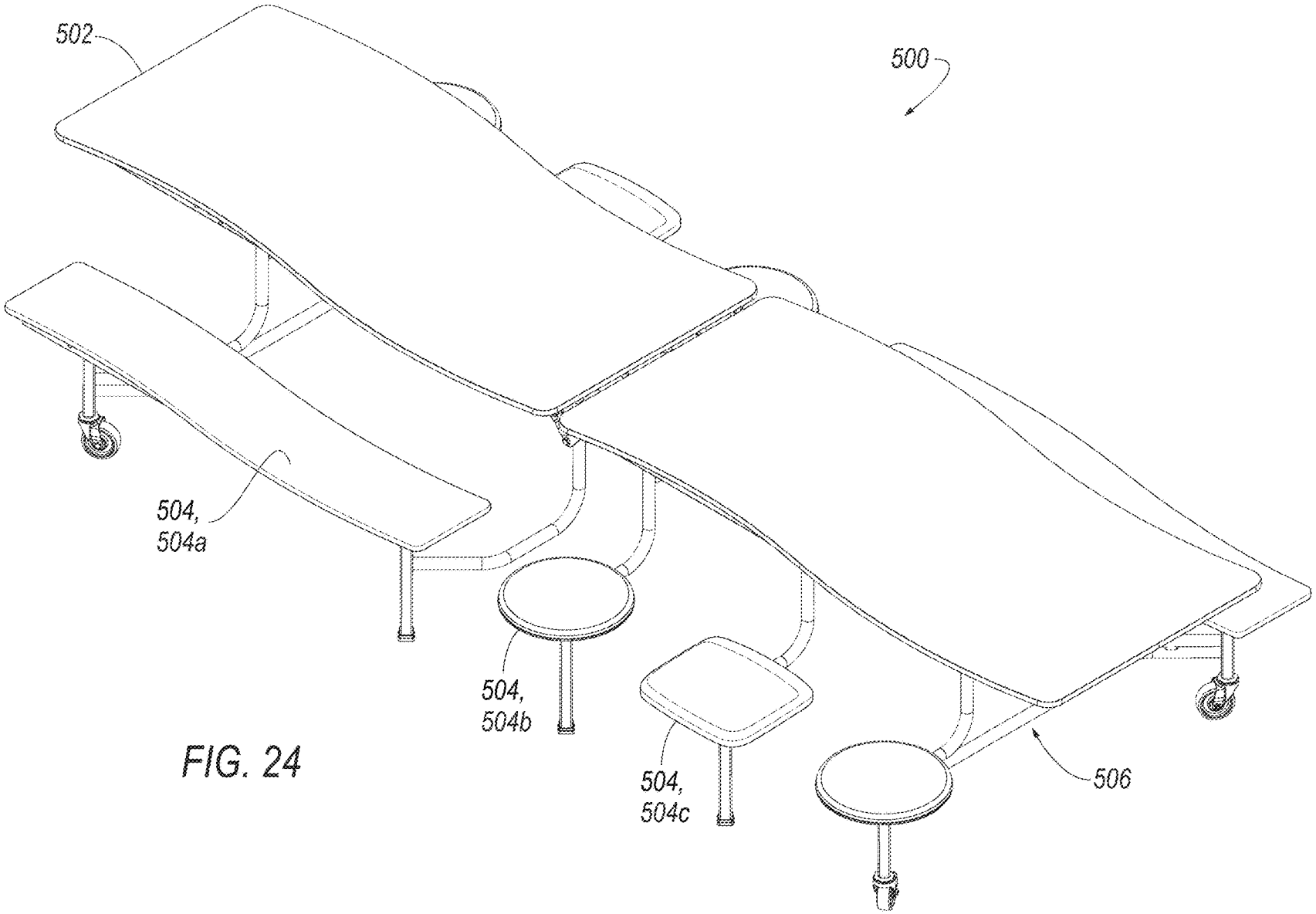
FIG. 24 is a perspective view of another table assembly having stool seats, wave-shaped bench seats, and a wave-shaped tabletop surface.

Optionally, the table assembly may include a mixture of bench seating and stool seating. For example, and in reference to FIG. 24, a table assembly 500 includes a tabletop 502 having a wave or sinusoidal shape with seats 504 of the table assembly 500 including wave-shaped bench seats 504*a*, circular or rounded stools 504*b*, and square or rectangular stools 504*c*. The circular stools 504*b* and square stools 504*c* may be interchangeable with one another, and/or swapped with other sizes or shapes of stools to provide a desired seating pattern. Further, the table assembly 500 includes a bench seat 504*a* opposite a set of stool seats 504*b*, 504*c*, with a frame 506 of the table assembly 500 adapted to accommodate the opposing seating configuration and enable folding of the table assembly 500. For example, the portions of the frame 506 supporting the bench seat 504*a* may be substantially similar to the example table assemblies 100, 200 of FIGS. 1-12 and the portions of the frame 506 supporting the stool seats 504*b*, 504*c* may be substantially similar to the example table assemblies 300, 400 of FIGS. 13-23. Thus, the frame 506 of the table assembly 500 is configured to support a combination of bench-style seating and stool-style seating with characteristics of the frames having the multi-stage deployment mechanism and locking mechanisms described herein.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

A number of implementations have been described. Nevertheless, it will be understood that various modifications may be made without departing from the spirit and scope of the disclosure. Accordingly, other implementations are within the scope of the following claims.

What is claimed is:

1. A table assembly comprising:

a frame comprising a first portion and a second portion, the first portion of the frame and the second portion of the frame pivotable relative to one another about a pivot axis;

a tabletop comprising a first portion supported at the first portion of the frame and a second portion supported at the second portion of the frame;

wherein the table assembly is movable between:

a use position, where the first portion of the tabletop and the second portion of the tabletop extend generally parallel to one another and a ground surface;

an intermediate position, where the first portion of the frame and the second portion of the frame are pivoted relative to one another about the pivot axis from the use position so that the first portion of the tabletop and the second portion of the tabletop extend at an oblique angle relative to the ground surface;

a folded position, where the first portion of the frame and the second portion of the frame are pivoted relative to one another about the pivot axis from the use position beyond the intermediate position; and a cleaning position, where the first portion of the frame and the second portion of the frame are pivoted relative to one another about the pivot axis between the use position and the intermediate position;

a multi-stage deployment mechanism operable to resist movement of the table assembly toward the use position, the multi-stage deployment mechanism configured to operate:

a first stage that, with the table assembly moved to the intermediate position, is engaged to resist movement of the table assembly from the intermediate position toward the use position; and a second stage that, with the table assembly moved to the cleaning position, is engaged to resist movement of the table assembly from the cleaning position toward the use position;

wherein the multi-stage deployment mechanism comprises a first biasing mechanism and a second biasing mechanism;

wherein the first biasing mechanism is configured to operate the first stage and the second stage; and wherein the second biasing mechanism is configured to operate a third stage that, with the table assembly moved to the use position, biases movement of the table assembly from the use position toward the intermediate position.

2. The table assembly of claim 1, wherein the first stage is engaged as the table assembly is moved between the use position and the intermediate position and the first stage is not engaged as the table assembly is moved between the intermediate position and the folded position.

3. The table assembly of claim 2, wherein the first biasing mechanism comprises a first end pivotally attached at the frame and a second end pivotally and slidably received along a slot of a yoke of a cylinder adapter bolted to the frame, the second end of the first biasing mechanism moving along the slot and engaging an end of the slot to engage the first stage as the table assembly is moved from the folded position to the intermediate position.

4. The table assembly of claim 1, wherein the second stage is engaged as the table assembly is moved between the use position and the cleaning position and the second stage is not engaged as the table assembly is moved between the cleaning position and the folded position.

5. The table assembly of claim 1, further comprising a locking mechanism that engages to retain the table assembly in the folded position, gravitational forces moving the table assembly from the folded position to the intermediate position responsive to disengagement of the locking mechanism.

6. The table assembly of claim 1, further comprising a bench seat comprising a first portion supported at the first portion of the frame and a second portion supported at the second portion of the frame.

7. The table assembly of claim 6, wherein the tabletop and the bench seat both comprise a wave shape.

8. The table assembly of claim 1, further comprising a first stool seat supported at the first portion of the frame and a second stool seat supported at the second portion of the frame.

9. The table assembly of claim 8, wherein a first leg extends from the first stool seat and a second leg extends from the second stool seat, the first leg and the second leg engaging the ground surface with the table assembly in the use position, and the first leg and the second leg remaining substantially parallel to one another as the table assembly moves between the use position and the folded position.

10. The table assembly of claim 8, wherein the first stool seat and the second stool seat each respectively comprise one selected from the group consisting of (i) a circular seating surface and (ii) a rectangular seating surface.

11. The table assembly of claim 1, wherein a mobility structure is disposed at the frame, the mobility structure not engaging the ground surface with the table assembly adjusted to the use position, and the mobility structure engaging the ground surface with the table assembly adjusted to the folded position to enable movement of the table assembly along the ground surface.

12. A table assembly comprising:

a frame comprising a first portion and a second portion, the first portion of the frame and the second portion of the frame pivotable relative to one another about a pivot axis;

a tabletop comprising a first portion supported at the first portion of the frame and a second portion supported at the second portion of the frame;

a seat comprising a first portion supported at the first portion of the frame and a second portion supported at the second portion of the frame;

wherein the table assembly is movable between:

a use position, where the first portion of the tabletop and the second portion of the tabletop extend generally parallel to one another and a ground surface;

an intermediate position, where the first portion of the frame and the second portion of the frame are pivoted relative to one another about the pivot axis from the use position so that the first portion of the tabletop and the second portion of the tabletop extend at an oblique angle relative to the ground surface;

a folded position, where the first portion of the frame and the second portion of the frame are pivoted relative to one another about the pivot axis from the use position beyond the intermediate position; and a cleaning position, where the first portion of the frame and the second portion of the frame are pivoted relative to one another about the pivot axis between the use position and the intermediate position; and a multi-stage deployment mechanism operable to resist movement of the table assembly toward the use position, the multi-stage deployment mechanism comprising:

a first biasing mechanism configured to operate:

a first stage that, with the table assembly moved to the intermediate position, is engaged to resist movement of the table assembly from the intermediate position toward the use position; and a second stage that, with the table assembly moved to the cleaning position, is engaged to resist movement of the table assembly from the cleaning position toward the use position; and a second biasing mechanism configured to operate having a third stage that, with the table assembly moved to the use position, biases movement of the table assembly from the use position toward the intermediate position.

13. The table assembly of claim 12, wherein the first stage is engaged as the table assembly is moved between the use position and the intermediate position and the first stage is not engaged as the table assembly is moved between the intermediate position and the folded position.

14. The table assembly of claim 12, wherein the first biasing mechanism comprises a first end pivotally attached at the frame and a second end pivotally and slidably received along a slot of a yoke of a cylinder adapter bolted to the frame, the second end of the first biasing mechanism moving along the slot and engaging an end of the slot to engage the first stage as the table assembly is moved from the folded position to the intermediate position.

15. The table assembly of claim 12, wherein the second stage is engaged as the table assembly is moved between the use position and the cleaning position and the second stage is not engaged as the table assembly is moved between the cleaning position and the folded position.

16. The table assembly of claim 12, further comprising a locking mechanism that engages to retain the table assembly in the folded position, gravitational forces moving the table assembly from the folded position to the intermediate position responsive to disengagement of the locking mechanism.

17. A table assembly comprising:

a frame comprising a first portion and a second portion, the first portion of the frame and the second portion of the frame pivotable relative to one another about a pivot axis;

a tabletop comprising a first portion supported at the first portion of the frame and a second portion supported at the second portion of the frame;

a first stool seat supported at the first portion of the frame;

a second stool seat supported at the second portion of the frame;

wherein the table assembly is movable between:

a use position, where the first portion of the tabletop and the second portion of the tabletop extend generally parallel to one another and a ground surface;

an intermediate position, where the first portion of the frame and the second portion of the frame are pivoted relative to one another about the pivot axis from the use position so that the first portion of the tabletop and the second portion of the tabletop extend at an oblique angle relative to the ground surface;

a folded position, where the first portion of the frame and the second portion of the frame are pivoted relative to one another about the pivot axis from the use position beyond the intermediate position; and a cleaning position, where the first portion of the frame and the second portion of the frame are pivoted relative to one another about the pivot axis between the use position and the intermediate position;

a multi-stage deployment mechanism operable to resist movement of the table assembly toward the use position, the multi-stage deployment mechanism configured to operate:

a first stage that, with the table assembly moved to the intermediate position, is engaged to resist movement of the table assembly from the intermediate position toward the use position, the first stage engaged as the table assembly is moved between the use position and the intermediate position and the first stage not engaged as the table assembly is moved between the intermediate position and the folded position; and a second stage that, with the table assembly moved to the cleaning position, is engaged to resist movement of the table assembly from the cleaning position toward the use position, the second stage engaged as the table assembly is moved between the use position and the cleaning position and the second stage not engaged as the table assembly is moved between the cleaning position and the folded position;

wherein the multi-stage deployment mechanism comprises a first biasing mechanism and a second biasing mechanism;

wherein the first biasing mechanism is configured to operate the first stage and the second stage; and wherein the second biasing mechanism is configured to operate a third stage that, with the table assembly moved to the use position, biases movement of the table assembly from the use position toward the intermediate position.

18. The table assembly of claim 17, wherein the first biasing mechanism comprises a first end pivotally attached at the frame and a second end pivotally and slidably received along a slot of a yoke of a cylinder adapter bolted to the frame, the second end of the first biasing mechanism moving along the slot and engaging an end of the slot to engage the first stage as the table assembly is moved from the folded position to the intermediate position.

19. The table assembly of claim 17, further comprising a locking mechanism that engages to retain the table assembly in the folded position, gravitational forces moving the table assembly from the folded position to the intermediate position responsive to disengagement of the locking mechanism.

20. The table assembly of claim 17, wherein a first leg extends from the first stool seat and a second leg extends from the second stool seat, the first leg and the second leg engaging the ground surface with the table assembly in the use position, and the first leg and the second leg remaining substantially parallel to one another as the table assembly moves between the use position and the folded position.

21. The table assembly of claim 17, wherein the first stool seat and the second stool seat each respectively comprise one selected from the group consisting of (i) a circular seating surface and (ii) a rectangular seating surface.

* * * * *